United States Patent [19]

Shimonosono et al.

[11] Patent Number: 4,669,427

[45] Date of Patent: Jun. 2, 1987

[54] COOLING SYSTEM FOR AUTOMOTIVE ENGINE OR THE LIKE INCLUDING QUICK COLD WEATHER WARM-UP CONTROL

[75] Inventors: Hitoshi Shimonosono, Yokosuka; Naoki Ogawa, Yokohama; Kazuyuki Fujigaya, Yokosuka; Yutaka Minezaki, Koshigaya, all of Japan

[73] Assignee: Nissan Motor Co., Ltd., Yokohama, Japan

[21] Appl. No.: 780,263

[22] Filed: Sep. 26, 1985

[30] Foreign Application Priority Data

| | | | |
|---|---|---|---|
| Sep. 29, 1984 | [JP] | Japan | 59-204588 |
| Sep. 29, 1984 | [JP] | Japan | 59-204589 |
| Sep. 29, 1984 | [JP] | Japan | 59-204591 |
| Sep. 29, 1984 | [JP] | Japan | 59-204590 |

[51] Int. Cl.[4] ..... F01P 3/22

[52] U.S. Cl. ..... 123/41.27

[58] Field of Search ..... 123/41.2–41.21, 123/41.44; 165/104.27, 104.32

[56] References Cited

U.S. PATENT DOCUMENTS

| | | | |
|---|---|---|---|
| Re. 16,676 | 7/1927 | Muir | 123/41.1 |
| 1,678,644 | 7/1928 | Mallory | 123/41.02 |
| 1,792,520 | 2/1931 | Weinhardt | 123/41.03 |
| 1,815,240 | 7/1931 | Clegg | 123/41.19 |
| 2,481,520 | 9/1949 | Knoy | 62/119.5 |
| 4,367,699 | 1/1983 | Evans | 123/41.23 |
| 4,545,335 | 10/1985 | Hayashi | 123/41.27 |

FOREIGN PATENT DOCUMENTS

| | | |
|---|---|---|
| 0019344 | 11/1980 | European Pat. Off. . |
| 0084378 | 7/1983 | European Pat. Off. . |
| 0021182 | 10/1984 | European Pat. Off. . |
| 0143326 | 6/1985 | European Pat. Off. . |

*Primary Examiner*—William A. Cuchlinski, Jr.

*Attorney, Agent, or Firm*—Schwartz, Jeffery, Schwaab, Mack, Blumenthal & Evans

[57] ABSTRACT

In order to improve engine warm-up characteristics under cold climatic conditions and to safegard against possible unintentional overfilling of the of the cooling circuit of an evaporative type automotive cooling system wherein the coolant is permitted to boil and the vapor used as a vehicle for removing heat from the engine, the ambient temperature or a parameter which varies with the same is sensed and the control of the cooling system modified accordingly. One main feature comes in the control which is effected to reduce the surface area of the radiator of the system in which the coolant vapor is condensed is modified to avoid overfilling and possible damage due to overpressurization.

19 Claims, 30 Drawing Figures

CPU
ROM
RAM
I/O
226
°C
280
271
272
200
202
204
206
208
210
212
214
215
216
218
220
222
224
228
230
232
234
236
238
240
244
246
248
254
256
268
270
H1
H2
(I)
(II)
(III)
A
B

SYSTEM INITIALIZATION ROUTINE (ALL EMBODIMENTS)

INTERRUPT ROUTINE (ALL EMBODIMENTS)

COLD NON-CONDENSIBLE MATTER PURGE CONTROL ROUTINE (FIRST AND SECOND EMBODIMENTS)

COOLANT JACKET LEVEL CONTROL ROUTINE (FIRST AND SECOND EMBODIMENTS)

RADIATOR LEVEL INCREASE CONTROL (FIRST EMBODIMENT)

COOLING SYSTEM FOR AUTOMOTIVE ENGINE OR THE LIKE INCLUDING QUICK COLD WEATHER WARM-UP CONTROL

BACKGROUND OF THE INVENTION

1. Field of the Invention

The present invention relates generally to a cooling system for an internal combustion engine wherein a liquid coolant is permitted to boil and the vapor used as a vehicle for removing heat from the engine, and more specifically to such a system which enables the engine to warm-up in the minimum amount of time in low temperature environments.

2. Description of the Prior Art

In currently used "water cooled" internal combustion engine such as shown in FIG. 1 of the drawings, the engine coolant (liquid) is forcefully circulated by a water pump, through a cooling circuit including the engine coolant jacket and an air cooled radiator. This type of system encounters the drawback that a large volume of water is required to be circulated between the radiator and the coolant jacket in order to remove the necessary amount of heat. Further, due to the large mass of water inherently required, the warm-up characteristics of the engine are undesirably sluggish. For example, if the temperature difference between the inlet and discharge ports of the coolant jacket is 4 degrees, the amount of heat which 1 Kgm of water may effectively remove from the engine under such conditions is 4 Kcal. Accordingly, in the case of an engine having 1800 cc displacement (by way of example) is operated throttle, the cooling system is required to remove approximately 4000 Kcal/h. In order to achieve this, a flow rate of 167 liter/min (viz., $4000-60\frac{1}{4}$) be produced oy the water pump. This of course undesirably consumes a number of otherwise useful horsepower.

FIG. 2 shows an arrangement disclosed in Japanese patent application Second Provisional Publication No. Sho. 57-57608. This arrangement has attempted to vaporize a liquid coolant and use the gaseous form thereof as a vehicle for removing heat from the engine. In this system the radiator 1 and the coolant jacket 2 are in constant and free communication via conduits 3, 4 whereby the coolant which condenses in the radiator 1 is returned to the coolant jacket 2 little by little under the influence of gravity.

This arrangemen while completely eliminating the power consuming circulation pump which plagues the FIG. 1 arrangement has suffered from the drawbacks that the radiator, depending on its position with respect to the engine proper, tends to be at least partially filled with liquid coolant. This greatly reduces the surface area via which the gaseous coolant (for example steam) can effectively release its latent heat of vaporization and accordingly condense, and thus has lacked any notable improvement in cooling efficiency.

Further, with this system in order to maintain the pressure within the coolant jacket and radiator at atmospheric level, a gas permeable water shedding filter 5 is arranged as shown, to permit the entry of air into and out of the system. However, this filter permits gaseous coolant to gradually escape from the system, inducing the need for frequent topping up of the coolant level.

A further problem with this arrangement has come in that some of the air, which is sucked into the cooling system as the engine cools, tends to dissolve in the water, whereby upon start up of the engine, the dissolved air tends to form small bubbles in the radiator which adhere to the walls thereof forming an insulating layer. The undissolved air also tends to collect in the upper section of the radiator and inhibit the convention-like circulation of the vapor from the cylinder block to the radiator. This of course further deteriorates the performance of the device.

European patent application Provisional Publication No. 0 059 423 published on Sept. 8, 1982 discloses wherein, liquid coolant in the coolant jacket of the engine, is not forcefully circulated therein and permitted to absorb heat to the point of boiling. The gaseous coolant thus generated is adiabatically compressed in a compressor so as to raise the temperature and pressure thereof and thereafter introduced into a heat exchanger (radiator). After condensing, the coolant is temporarily stored in a reservoir and recycled back into the coolant jacket via a flow control valve.

This arrangement has suffered from the drawback that air tends to leak into the system upon cooling thereof. This air tends to be forced by the compressor along with the gaseous coolant into the radiator. Due to the difference in specific gravity, the air tends to rise in the hot environment while the coolant which has condensed moves downwardly. Accordingly, air, due to this inherent tendency to rise, forms pockets of air which cause a kind of "embolism" in the radiator and badly impair the heat exchange ability thereof. U.S. Pat. No. 4,367,699 issued on Jan. 11, 1983 in the name of Evans (see FIG. 3 of the drawings) discloses an engine system wherein the coolant is boiled and the vapor used to remove heat from the engine. This arrangement features a separation tank 6 wherein gaseous and liquid coolant are initially separated. The liquid coolant is fed back to the cylinder block 7 under the influence of gravity while the "dry" gaseous coolant (steam for example) is condensed in a fan cooled radiator 8. The temperature of the radiator is controlled by selective energizations of the fan 9 to maintain a rate of condensation therein sufficient to maintain a liquid seal at the bottom of the device. Condensate discharged from the radiator via the above mentioned liquid seal is collected in a small reservoir-like arrangement 10 and pumped back up to the separation tank via a small constantly operated pump 11.

This arrangement, while providing an arrangement via which air can be initially purged to some degree from the system tends to, due to the nature of the arrangement which permits said initial non-condensible matter to be forced out of the system, suffer from rapid loss of coolant when operated at relatively high altitudes. Further, once the engine cools air is relatively freely admitted back into the system.

The provision of the separation tank 6 also renders engine layout difficult in that such a tank must be placed at relatively high position with respect to the engine, and contain a relatively large amount of coolant so as to buffer the fluctuations in coolant consumption in the coolant jacket. That is to say, as the pump 11 which lifts the coolant from the small reservoir arrangement located below the radiator, is constantly energized (apparently to obivate the need for level sensors and the like arrangement which could control the amount of coolant returned to the coolant jacket) the amount of coolant stored in the seperation tank must be sufficient as to allow for sudden variations in the amount of coolant consumed in the coolant jacket due to sudden changes in the amount of fuel combusted in the combustion chambers of the engine. In the event that pump 11 fails however, the system is rendered inoperative as the supply of coolant in the separation tank 6 is soon consumed.

Japanese patent application First Provisional Publication No. sho. 56-32026 (see FIG. 4 of the drawings) discloses an arrangement wherein the structure defining the cylinder head and cylinder liners are covered in a porous layer of ceramic material 12 and coolant sprayed into the cylinder block from shower-like arrangements 13 located above the cylinder heads 14. The interior of the coolant jacket defined within the engine proper is essentially filled with only gaseous coolant during engine operation during which liquid coolant is sprayed onto the ceramic layers 12. However, this arrangement has proven totally unsatisfactory in that upon boiling of the liquid coolant absorbed into the ceramic layers, the vapor thus produced and which escapes into the coolant jacket inhibits the penetration of fresh liquid coolant and induces the situation wherein rapid overheat and thermal damage of the ceramic layers 12 and/or engine soon results. Further, this arrangement is plagued with air contamination and blockages in the radiator similar to the compressor equipped arrangement discussed above.

FIG. 7 shows an arrangement which is disclosed in copending U.S. patent application Ser. No. 663,911 filed on Oct. 23, 1984 in the name of Hirano now U.S. Pat. No. 4,549,505. The disclosure of this application is hereby incorporated by reference thereto.

This arrangement while overcoming the problems inherent in the above discussed prior art has also suffered from the drawbacks that whenever the engine is started and the coolant temperature is below a predetermined level, a so called non-condensible matter purge operation is carried wherein excess coolant is pumped into the engine cooling circuit until an excess flows over back to the reservoir carrying with it any bubbles of air or the like which may have scollected in the system. This under reasonable atmospheric temperatures causes no particular problem. However, when the ambient temperature is very low, for example sub-zero a problem is encountered that the coolant stored in the reservoir is apt to be very cold, Hence, when the engine is started, at the very time it is desired to raise the temperature of the coolant from the point of warming the engine, the engine lubricant and coolant (and thus enable the vehicle cabin heater to be used as soon as possible) extremely cold coolant is injected into the coolant jacket for up to several tens of seconds. This of course apart from hampering the warm-up process notably, also directs very cold coolant against parts such as the structure which defines the cylinder heads exhaust ports etc., tending to chill same and induce the formation of undesirably amounts of HC and CO and even cracking of same due to the formation of large temperature gradients.

It should be noticed that the same numerals as used in the above mentioned patent application are also used in FIG. 7.

SUMMARY OF THE INVENTION

It is an object of the present invention to provide a control arrangement for an evaporative cooling system which expedites engine warm-up in cold climatic conditions.

In brief, the above object is achieved by using one or more the following techniques:

(a) sensing the coolant temperature at engine start-up and if below a level which indicates that the ambient temperature is low and apt to interfere with engine warm-up, holding a purge operation wherein coolant from an auxiliary reservoir is pumped into the cooling circuit in order to purge out any non- condensible matter which migh have found its way into the system, until the coolant heats to a relatively high level (for example 80° C.) before the purge is permitted;

(b) sensing the coolant temperature during an operation wherein the level of liquid coolant in radiator of the system is purposely increased to reduce the surface area available for the coolant vapor to release its latent heat of evaporation and condense, and stopping the level raising in the event that the colant temperature is at a level which invites the control to overfill the radiator with coolant which is itself quite cold and detremental to engine warm-up;

(c) rapidly reducing the amount of coolant which must be actually heated by forcefully pumping excess coolant out of the system while simultaneously permitting non-condensible matter (air) to enter the system to prevent the formation of a vacuum which would interfere with temperature control and/or possibly to crush the conduiting and other structure of the system; and subsequently flushing out the non-condensible matter as required by briefly switching the system to open circuit when fully warmed up; and permitting the coolant to warm-up with the system in an open circuit state without any introduction of coolant or forced pumping until the temperature at the bottom of the radiator undergoes an increase which denotes the complete filling of the radiator with coolant vapor.

In its broadest form the present invention takes the form of a method of cooling an internal combustion engine having a structure subject to high heat flux, which is characterized by the steps of: introducing liquid coolant into a coolant jacket disposed about the structure; (b) permitting the liquid coolant to boil and produce coolant vapor; (c) condensing the vapor produced in the coolant jacket to its liquid form in a radiator which is surrounded by a cooling medium; (d) returning the liquid coolant condensate from the radiator to the coolant jacket in a manner to maintain the structure immersed in a predetermined depth of liquid coolant; (e) sensing the temperature of the coolant in the coolant jacket; (f) sensing a parameter which varies with the effect of ambient temperature on the rate at which the temperature of the engine increases during engine warm-up; and (g) modifying the communication between a reservoir in which liquid coolant is stored and a cooling circit defined by the coolant jacket and the radiator in response to the parameter sensing step in a manner which promotes rapid warm-up.

A more specific form of the invention comes in a method of cooling an internal combustion engine having a structure subject to high heat flux, which is characterized by the steps of: (a) introducing liquid coolant into a coolant jacket disposed about the structure; (b) permitting the liquid coolant to boil and produce coolant vapor; (c) condensing the vapor produced in the coolant jacket to its liquid form in a radiator which is surrounded by a cooling medium; (d) returning the liquid coolant condensate from the radiator to the coolant jacket in a manner to maintain the structure immersed in a predetermined depth of liquid coolant; (e) storing coolant in a reservoir; (f) permitting the coolant in the reservoir to enter and fill the coolant jacket and radiator when the engine is stopped and below a first predetermined temperature; (h) pumping coolant into the coolant jacket and radiator when the engine is started in a manner that the excess coolant introduced into the coolant jacket and radiator overflows via an overflow conduit back to the reservoir in a manner which flushes non-condensible matter out of the coolant jacket and radiator; (i) sensing the temperature of the coolant in one of the radiator and coolant jacket; and (j) delaying the pumping step when the temperature of the coolant is sensed being below a second predetermined temperature which is lower than the first predetermined one until the temperature of the coolant has risen above a third predetermined value.

Another aspect of the invention comes in a method of cooling an internal combustion engine having a structure subject to high heat flux, which is characterized by the steps of: (a) introducing liquid coolant into a coolant jacket disposed about the structure; (b) permitting the liquid coolant to boil and produce coolant vapor; (c) condensing the vapor produced in the coolant jacket to its liquid form in a radiator which is surrounded by a cooling medium; (d) returning the liquid coolant condensate from the radiator to the coolant jacket in a manner to maintain the structure immersed in a predetermined depth of liquid coolant; (e) storing coolant in a reservoir; (f) pumping coolant from the reservoir into the radiator in a manner which varies the amount of coolant in the radiator and varies the surface area of the radiator via which coolant vapor can release its latent heat of evaporation; (g) sensing the ambient temperature; (h) modifying the pumping in step (f) in response to the ambient temperature being sensed below a predetermined low temperature in step (g).

Yet another aspect of the invention comes in a method cooling an internal combustion engine having a structure subJect to high heat flux, which method is characterized by: (a) introducing liquid coolant into a coolant jacket disposed about the structure; permitting the liquid coolant to boil and produce coolant vapor; (c) condensing the vapor produced in the coolant jacket to its liquid form in a radiator which is surrounded by a cooling medium; (d) returning the liquid coolant condensate from the radiator to the coolant jacket in a manner to maintain the structure immersed in a predetermined depth of liquid coolant; (e) sensing the temperature of the coolant in the coolant jacket; (f) storing coolant in a reservoir; (g) permitting coolant in the reservoir to enter and fill the coolant jacket and radiator when the engine is stopped and below a selected temperature; (h) pumping coolant out of the coolant jacket and radiator to the reservoir; (i) permitting non-condensible matter to enter the coolant jacket and radiator in a manner to prevent the formation of a negative pressure; (j) sealing the coolant jacket and radiator in a manner to defined a closed circuit cooling circuit upon one of: (i) a minimum amount of coolant being retained in the cooling circuit, and (ii) the coolant boiling at a temperature determined to be that most suited form the instant set of operational conditions; and (k) venting coolant vapor from the radiator in a manner to scavenge the non-condensible matter out of the cooling circuit in the event that the temperature of the coolant exceeds a predetermined upper limit.

Yet another aspect of the present comes in a method of cooling an internal combustion engine having a structure subject to high heat flux, comprising the steps of: (a) introducing liquid coolant into a coolant jacket disposed about the structure; (b) permitting the liquid coolant to boil and produce coolant vapor; (c) condensing the vapor produced in the coolant jacket to its liquid form in a radiator which is surrounded by a cooling medium; (d) returning the liquid coolant condensate from the radiator to the coolant jacket in a manner to maintain the structure immersed in a predetermined depth of liquid coolant; (e) sensing the temperature of the coolant in the coolant jacket; (f) storing coolant in a reservoir; (g) permitting the coolant in the resevoir to enter and fill the radiator when the engine is stopped and below a first predetermined temperature; (h) permitting the coolant in the coolant jacket to heat when the engine is started with the coolant jacket and radiator conditioned so that the cooling circiut defined by the coolant jacket and the radiator assumes an open circuit state wherein fluid communication between the coolant jacket and the radiator and the reservoir is permitted; sensing the temperature at a lower portion of the radiator; using a change in temperature at the lowër portion of the radiator as a signal to seal the radiator and coolant jacket so as to assume a closed circuit state by cutting off fluid communication betweeen the radiator and coolant jacket and the reservoir.

In terms of apparatus the present invention is deemed to take the form of a cooling system for an internal combustion engine having a structure subject to high heat flux and which comprises: a cooling circuit which includes (a) a coolant jacket disposed about the highly heated structure into which coolant is introduced in liquid form and permitted to boil, (b) a radiator in which the gaseous coolant produced in the coolant jacket is condensed to its liquid form, (c) a vapor transfer conduit which leads from the coolant jacket to the radiator and through which the gasesous coolant produced in the coolant jacket is transferred to the radiator, and (d) means which returns the liquid condensate from the radiator to the coolant jacket in a manner which maintains the highly heated structure of the engine immersed in predetermined depth of liquid coolant; a temperature sensor which senses the temperature of the the coolant in the coolant jacket; a device which is associated with the radiator and which is operable to increase the heat exchange between the radiator and a cooling medium which surrounds the same; a reservoir in which liquid coolant is stored; valve and conduit means which fluidly interconnects the reservoir and the cooling ciruit; and a control circuit which is responsive the temperature sensor and which controls the device and the valve and conduit means, the control circuit including means which is responsive to a parameter which varies with the ambient temperature and which modifies the the operation of the valve and conduit means to vary the amount of liquid coolant which is transferred between the cooling circuit and the reservoir in a manner which promotes rapid system warm-up.

BRIEF DESCRIPTION OF THE DRAWINGS

The features and advantages of the arrangement of the present invention will become more clearly appreciated from the following description taken in conjunction with the accompanying drawings in which.

DETAILED DESCRIPTION OF THE PREFERRED EMBODIMENTS

Before proceeding with the description of the embodiments of the present invention, it is deemed appropriate to discuss some of the basic features of the type of cooling system to which the embodiments of the present invention are applied.

Figure 1:
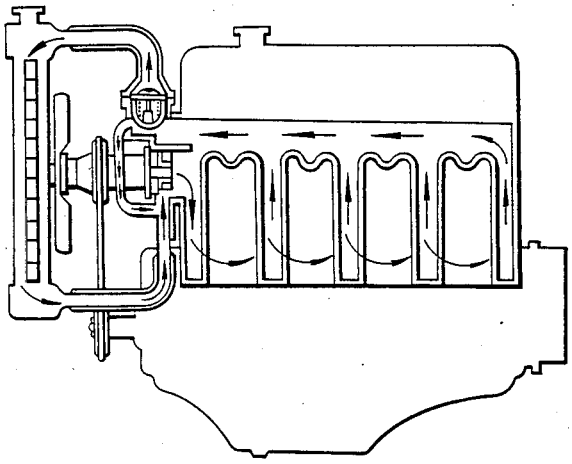
FIG. 1 (PRIOR ART)
FIGS. 1 to 4 show the prior art arrangements discussed briefly in the opening paragraphs of the instant disclosure.
Figure 2:
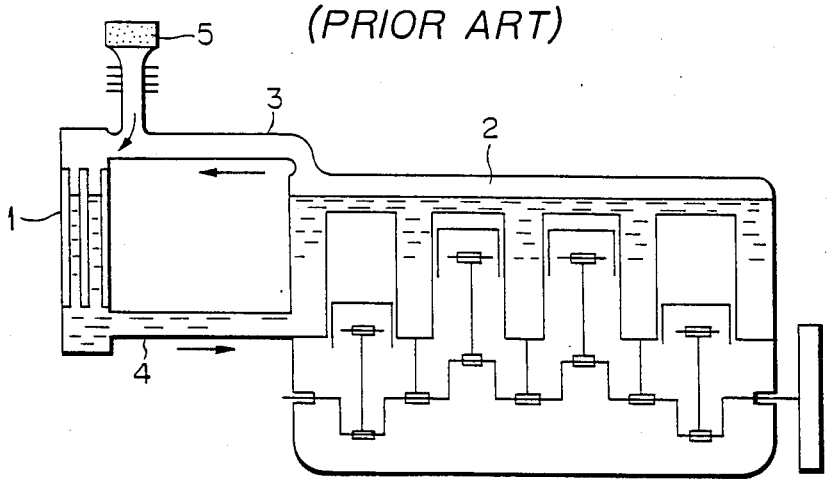
FIG. 2 (PRIOR ART)
Figure 3:
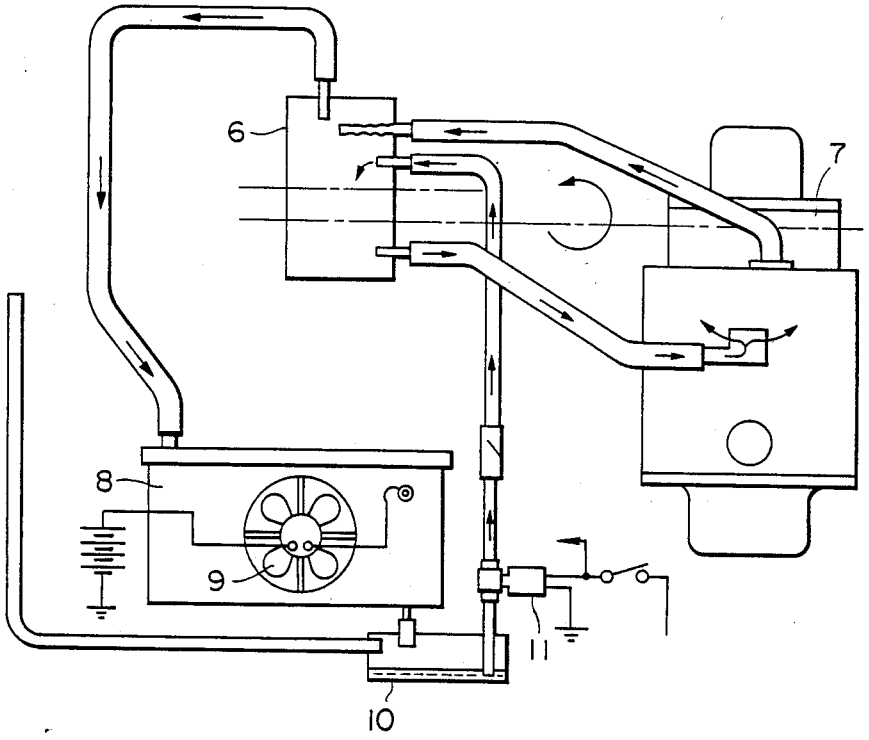
FIG. 3 (PRIOR ART)
Figure 4:
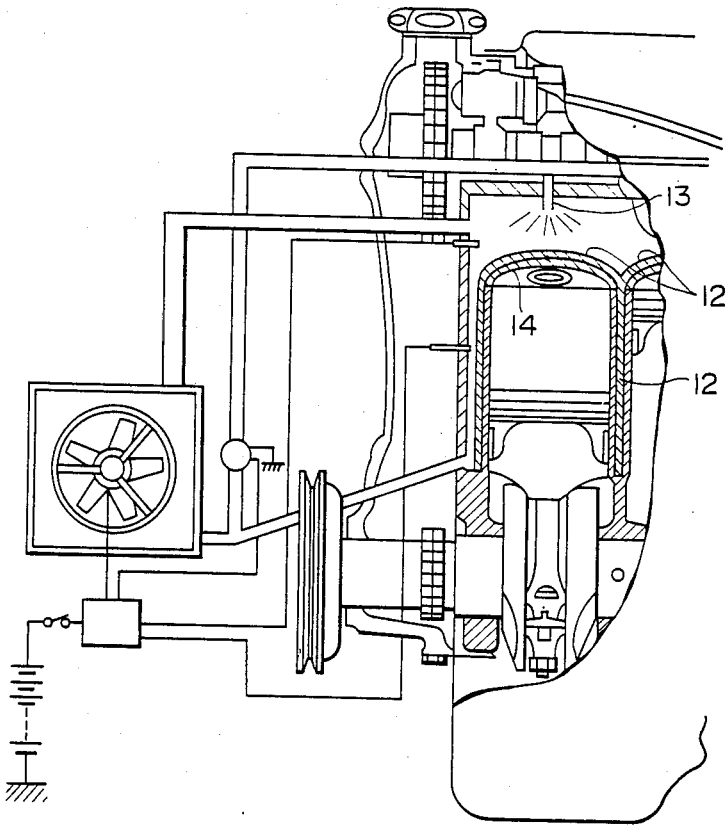
FIG. 4 (PRIOR ART)
Figure 5:
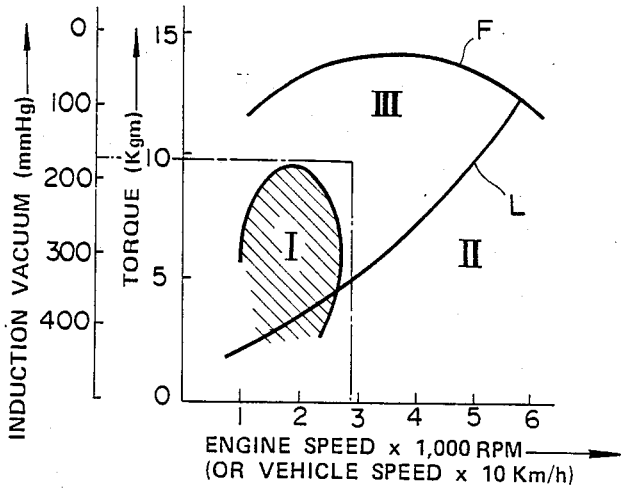
FIG. 5 is a graph showing in terms of induction vacuum (load) and engine speed the various load zones encountered by an automotive internal combustion engine.
Figure 6:
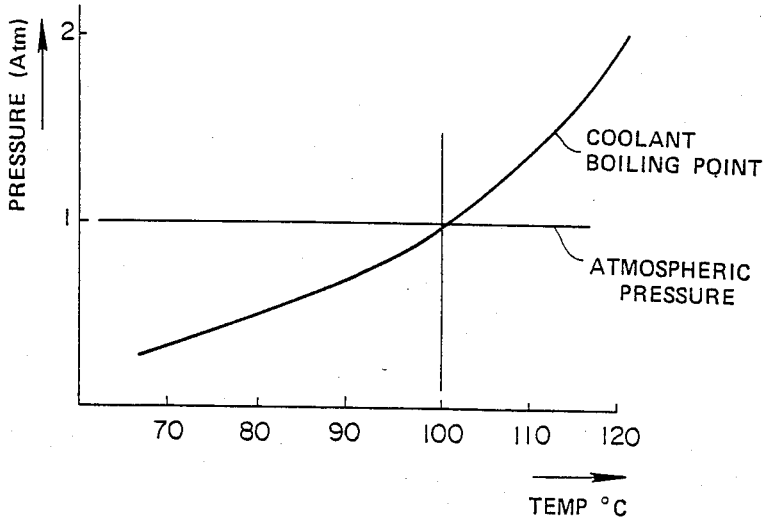
FIG. 6 is a graph showing in terms of pressure and temperature, the change which occurs in the coolant boiling point with change in pressure.

FIG. 5 graphically shows in terms of engine torque and engine speed the various load "zones" which are encountered by an automotive vehicle engine. In this graph, the curve F denotes full throttle torque characteristics, trace L denotes the resistance encountered when a vehicle is running on a level surface, and zones I, II and III denote respectively "urban cruising", "high speed cruising" and "high load operation" (such as hillclimbing, towing etc.).

A suitable coolant temperature for zone I is approximately 110° C. while 90°-80° C. for zones II and III. The high temperature during "urban cruising" promotes improved thermal efficiency. On the other hand, the lower temperatures ensure that sufficient heat is removed from the engine and associated structure to prevent engine knocking and/or engine damage in the other zones. For operational modes which fall between the aforementioned first, second and third zones, it is possible to maintain the engine coolant temperature at approximately 100° C.

Figure 7:
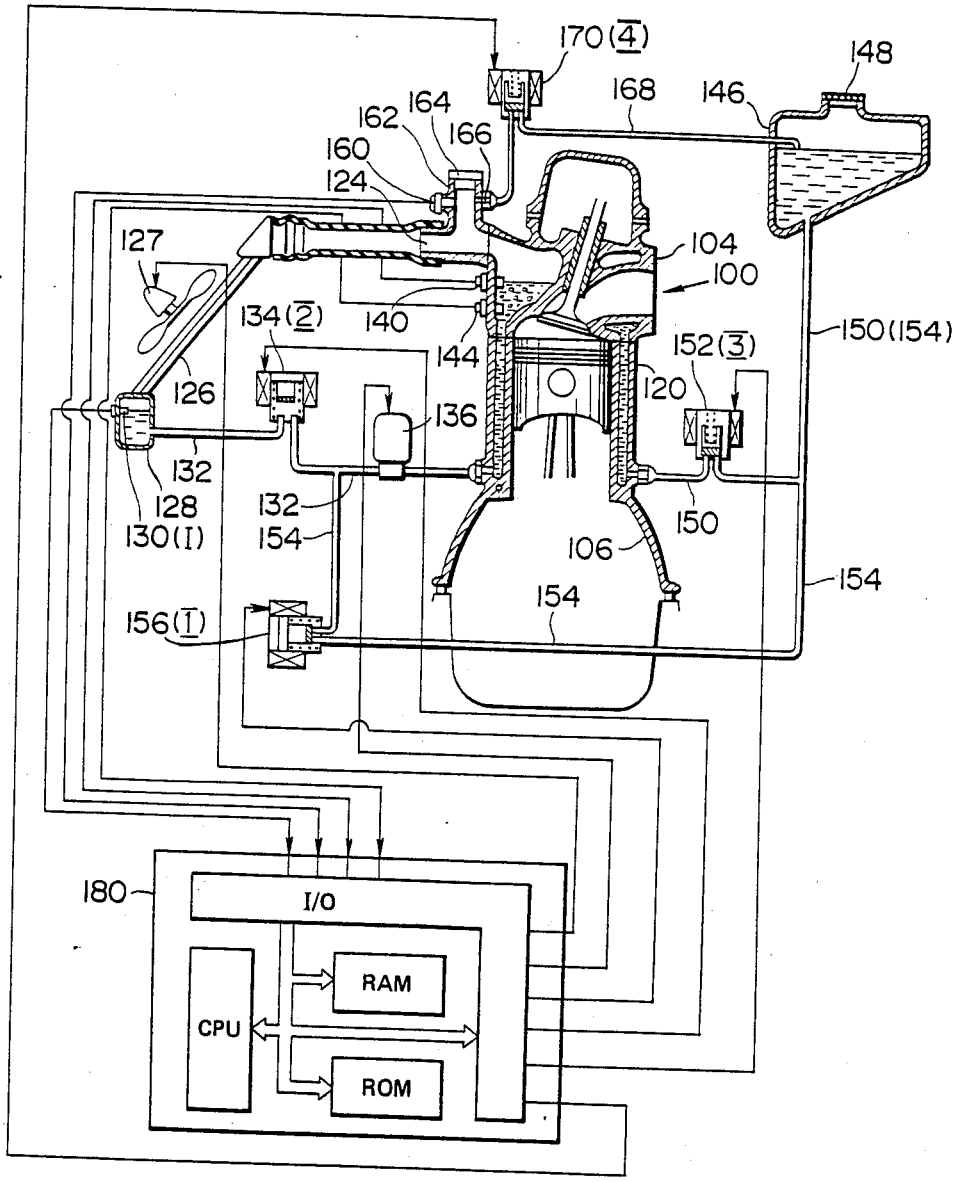
FIG. 7 shows in schematic elevation the arrangement disclosed in the opening paragraphs of the instant is conjunction with copending USN 663,911 now U.S. Pat. No. 4,549,505.

With the present invention, in order to control the temperature of the engine, advantage is taken of the fact that with a cooling system wherein the coolant is boiled and the vapor used a heat transfer medium, the amount of coolant actually circulated between the coolant jacket and the radiator is very small, the amount of heat removed from the engine per unit volume of coolant is very high, and upon boiling, the pressure prevailing within the coolant jacket and consequently the boiling point of the coolant rises if the system employed is closed. Thus, by circulating only a limited amount of cooling air over the radiator, it is possible reduce the rate of condensation therein and cause the pressure within the cooling system to rise above atmospheric and thus induce the situation, as shown in FIG. 7, wherein the engine coolant boils at temperatures above 100° C. for example at approximately 119° C. (corresponding to a pressure of approximately 1.9 Atmospheres).

On the other hand, high speed cruising, it is further possible by increasing the flow cooling air passing over the radiator, to increase the rate of condensation within the radiator to a level which reduces the pressure prevailing in the cooling system below atmospheric and thus induce the situation wherein the coolant boils at temperatures in the order of 80° to 90° C. However, under such conditions the tendency to find its way into the interior of the cooling circuit becomes excessively high and it is desirable under these circumstances to limit the degree to which a negative pressure is permitted to develop. This can be achieved by permitting coolant to be introduced into the cooling circuit from the reservoir and thus raise the pressure in the system to a suitable level.

Figure 8:
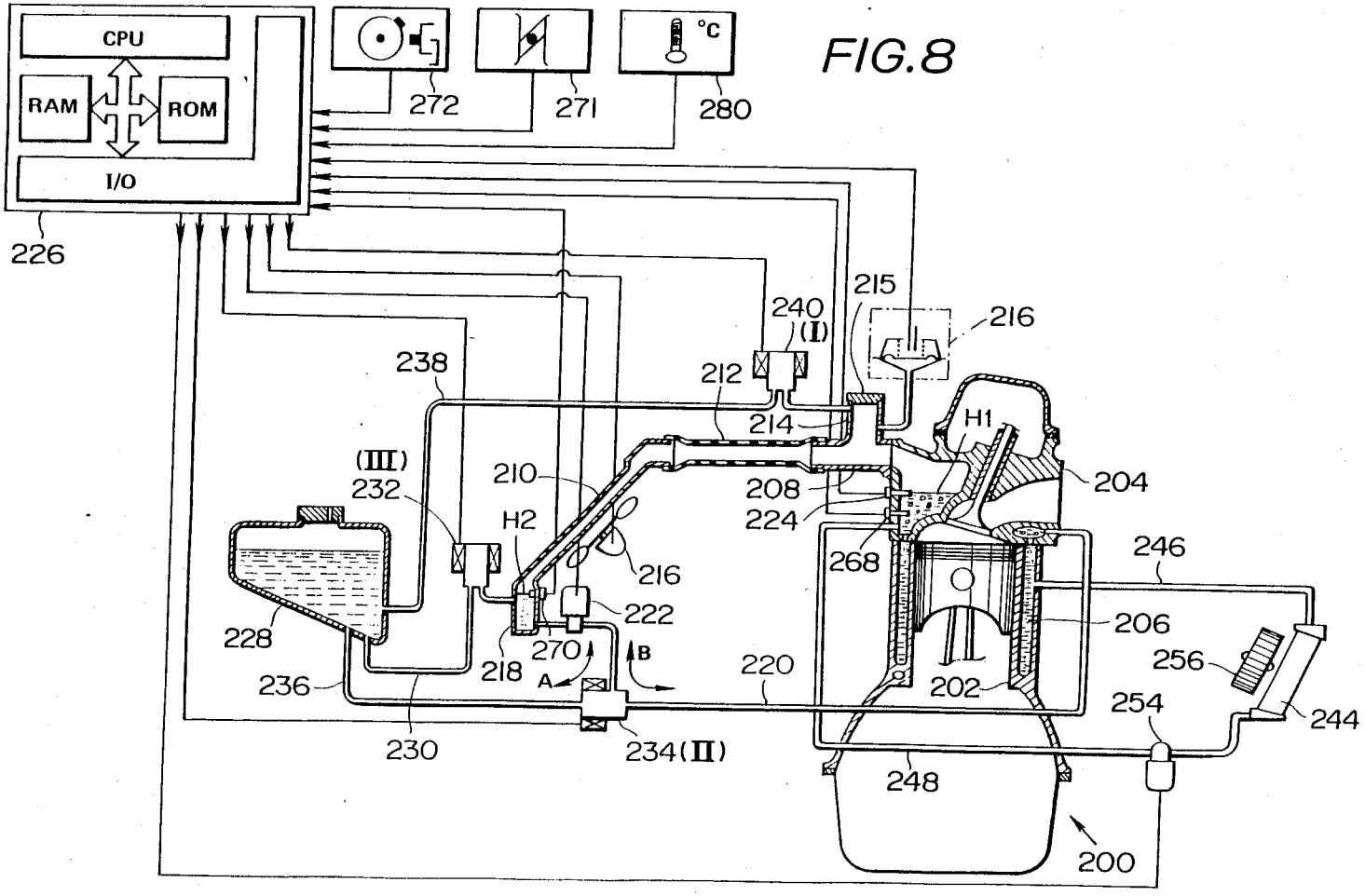
FIG. 8 is an engine system to which first and second embodiments of the present invention are applied.

FIG. 8 shows an engine system to which first and second embodiments of the present invention are applied.

In this arrangement an engine 200 includes a cylinder block 202 on which a cylinder head 204 is detachably secured. The cylinder block and cylinder head are formed with suitable cavities in a manner to define a coolant jacket 206 about structure of the engine such as the combustion chambers exhaust ports and valves which are subject to a high heat flux. A vapor manifold 208 secured to the cylinder head 204 communicates with a condenser or radiator 210 as it will be referred to hereinafter, via a vapor transfer conduit 212. The vapor manifold 208 is formed with a riser 214 which is hermetically sealed by a cap 215. Communicating with the vapor manifold 208 at a location adjacent the riser 214 is a pressure responsive switch arrangement 216. In this embodiment the switch is arranged to be triggered in response to a predetermined (negative) pressure differential developing between the interior of the coolant jacket 206 and the ambient atmosphere.

Located adjacent the radiator 210 is an electrically driven fan 216 which is arranged to selectively increase the flow of ambient air over the surface of the tubing and the like which constitutes the heat exchanging surface area of the radiator 210. Disposed at the bottom of the radiator 210 is a small collection vessel or lower tank 218 as it will be referred to hereinafter.

A coolant return conduit 220 leads from the lower tank 218 to the coolant jacket 206 of the engine 200. A small capacity reversible coolant return pump 222 is disposed in this conduit and arranged to be selectively energizable in a manner which when operated in a first or "forward" direction inducts coolant from the lower tank 218 and forces same toward and into the coolant jacket 206. In this embodiment the return conduit communicates with a second of the coolant jacket formed in the cylinder head 204. This arrangement is advantageous from the point of introducing relatively cool coolant into a zone wherein boiling tends to be most vigorous. This style of coolant introduction tends to damp the frothing and bumping which tends to frequently occur in this zone (viz., a zone close to the highly heated cylinder heads, exhaust ports and valves of the engine.

In order to maintain the level of coolant at a first predetermined level H1 a first level sensor 224 is disposed in the coolant jacket as shown. As will be appreciated the level H1 is selected to be a predetermined height above the upper level the structure of the engine subject to the highest heat flux (viz., the combustion chambers, exhaust ports and valves). The output of sensor 224 is fed to a control circuit 226 which in this embodiment includes a microprocessor comprised of a CPU, RAM, ROM and an in-out interface I/O. The control circuit 226 in turn issues an energizing signal to the coolant return pump 222 each time that level sensor 224 indicates that the level of coolant in the coolant jacket 206 has decreased below level H1 and it is necessary to replenish same in order to maintain the highly heated structure of the engine immersed in sufficient liquid coolant and thus avoid localized dry-outs and hot spot formation which tend to occur upon the occurrance of vigorous bumping and frothing of the boiling coolant. It is within the scope of the present invention to arrange for the level sensor to exhibit hysteresis characteristics so as to obviate rapid ON/OFF cycling of pump 222 in the event that such control is not provided in the soft ware of the microprocessor.

Located adjacent the engine 200 is a coolant reservoir 228. This reservoir is arranged to communicate with the cooling circuit of the engine—viz., the coolant jacket 206, vapor manifold 208, vapor transfer conduit 212, radiator 210, coolant return conduit 220 and pump 222—via a valve and conduit arrangement which includes: a coolant fill/discharge conduit 230 which leads from the reservoir 228 to the lower tank 218; an ON/-OFF type electromagnetic valve 232 which is disposed in this conduit and arranged to permit fluid communication between the reservoir 228 and lower tank 218 when de-energized; a three-way valve 234 which is disposed in the coolant return conduit 220 at location between the coolant return pump 222 and the coolant jacket 206 and which is arranged to selectively provide fluid communication between the reservoir 228 via a coolant induction conduit 236 (viz., flow path A) when in a first state (in this case de-energized) and establish "normal" communication between the pump and the coolant jacket 206 (flow path B) when in a second state (energized); and overflow conduit 238 which leads from a "purge" port formed in the riser 214 immediately below the cap 215; and a normally closed ON/OFF type valve 240 disposed in overflow conduit 238 and which permits fluid communication between the cooling circuit and the reservoir 228 when energized to assume an open state.

Disposed in a cabin (not shown) of the vehicle is a heater arrangement including a core 244 through which heated coolant may be circulated. As shown, core 244 communicates with the coolant jacket 206 via conduits 246, 248. The first conduit 246 is arranged to communicate with the cylinder block 204 while the second conduit 248 is arranged to communicate with the cylinder head 204 at a level below H1.

A coolant circulation pump 254 is disposed in the second conduit 248.

The cabin heating arrangement further includes a fan 256 for forcing a draft of air through the finning of the heater core. As heating and/or air-conditioning arrangements are well known in the art no further discussion of same will be given for brevity.

A temperature sensor 268 is disposed in the coolant jacket 206. In this embodiment sensor 268 is arranged in the cylinder head 204 in a manner to be immersed in the liquid coolant and in close proximity to the most highly heated structure of the engine. The output of the temperature sensor 268 is fed to the control circuit 226.

In order to facilitate the control of the cooling system during the various modes of operation thereof, a second level sensor 270 is disposed in the lower tank 218 and arranged to sense the level of coolant having reached a second level H2 which is selected to be lower than the tubing of the radiator 210 via which the latent heat of evaporation of the coolant is released to the surrounding ambient atmosphere; and essentially at the same level as fill/discharge conduit 230. This particular arrangement is deemed advantageous in the event that a "hot non-condensible purge" should be necessary to flush out any stubborn pockets of air which may be trapped in the radiator 210 and reducing the heat exchange efficiency thereof to the point of inducing system overheat. Viz., should the temperature rise to a level which cannot be controlled via energizations of fan 216 it is possible to momentarily open valve 232 and permit the pressurized vapor in the radiator 210 to vent out through conduit 230 to the reservoir 228. As will be appreciated, in order to minimize the amount of coolant which is displaced during this mode of operation and to maximize the tendency for any air or the like non-condensible matter in the radiator to be flushed out with the vented vapor, it is advantageous to arrange the lower end of conduit at level H2 whereat the level of liquid coolant in the lower tank is frequently maintained.

In order to sense the load and/or other engine operational parameters a load sensor 271 and an engine speed sensor 272 are arranged to submit data signals to control circuit 226. The load sensor 271 may take the form of a throttle valve position switch, air flow meter an induction vacuum switch on the like. Alternatively, the pulse width of a fuel injection control signal may be used. The engine ignition system may be tapped to provide the engine speed signal in the event that a crank angle sensor is not available.

An ambient temperature sensor 280 which may form part of an air conditioning unit or the like, is arranged to provide a data input indicative of the instant temperature of the environment in which the engine is operating.

Prior to initial use it is necessary to completely fill the cooling circuit and the conduiting 246, 248 and heater core 244 which form vital part of the heating system with liquid coolant in a manner to completely displace any non-condensible matter. This operation may be accomplished by removing cap 215 and manually filling the system. At this time it is deemed advantageous to energize coolant circulation pump 254 in a manner which flushes out any air that might be in the core 4 and conducting 246, 248. To facilitate this operation it is possible to add a manually operable switch (not shown) which selectively energizes the pump. It is further possible to introduce coolant into the reservoir 228 and manually induce the energization of the valves 232, 234 and pump 222 (in a second or "reverse" flow direction) and thus pump excess coolant into the system until a visible overflow occurs at the riser 214. This type of arrangement also facilitates regular servicing of the system.

FIRST EMBODIMENT

A first embodiment of the present invention overcomes the drawbacks encountered with the arrangement of FIG. 7 by sampling the coolant temperature at the time of engine start up and if below a predetermined level (indicative of low ambient temperatures) holding the start of the non-condensible matter purge until such time as the engine has warmed and accumulated sufficient heat and the engine lubricant warmed to a reasonable level 80° C.) before permitting same to be put into effect. As will be appreciated by permitting the engine to warm to a relatively high level in this manner sufficient heat is permitted to accumulate in the coolant and engine per se as to offset or render vitually non-existent any detrimental effects due to the introduction of what will inevitably be relatively cold fresh coolant.

This embodiment of the present invention will become more clearly appreciated as a discussion of the flow charts of FIGS. 11 to 20 proceeds.

SYSTEM CONTROL ROUTINE

(First Embodiment)

Figure 11:
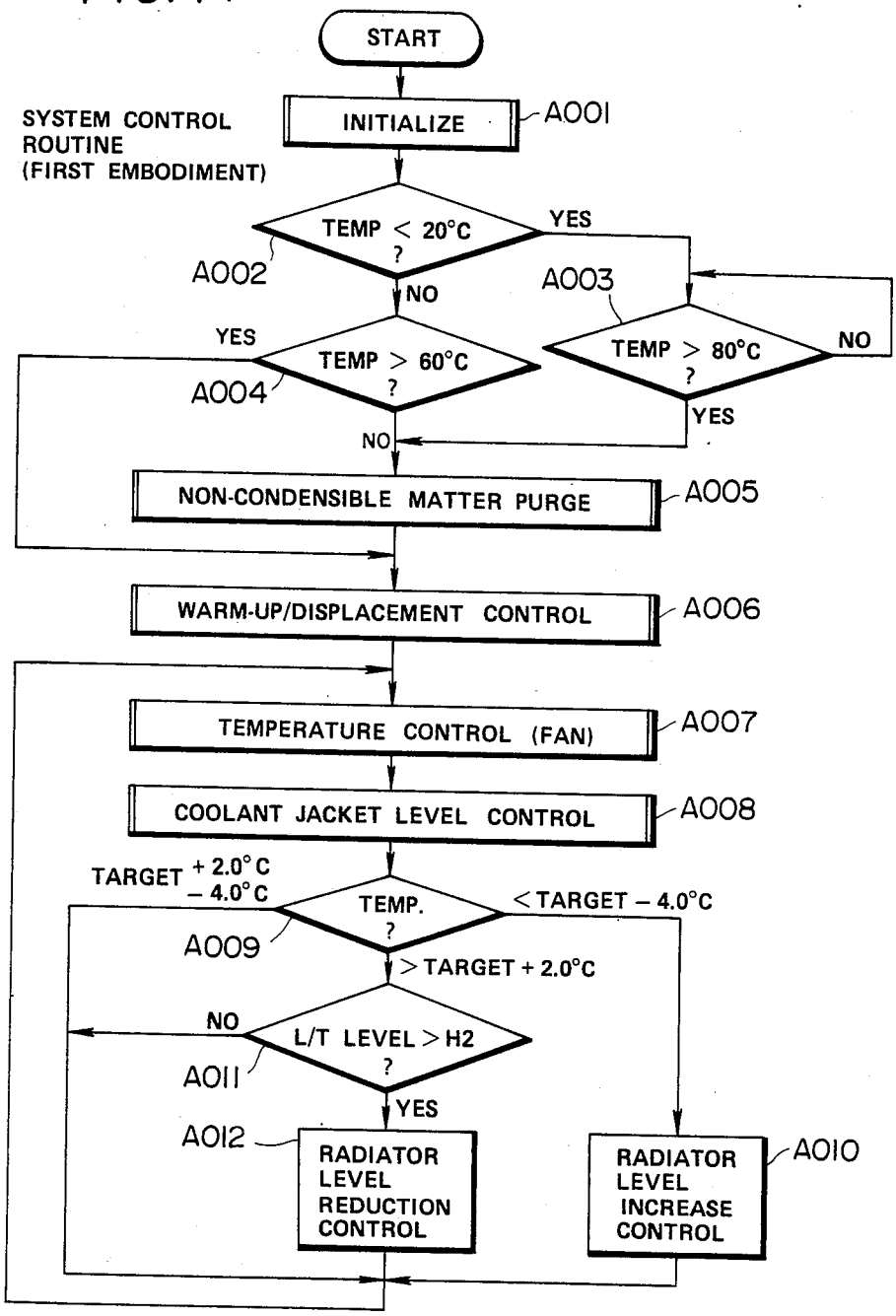
FIGS. 11 to 30 are flow charts which illustrate the control which characterizes the operation of the first to fourth embodiments of the present invention.

FIG. 11 shows in flow chart form a control routine which shows the steps which characterize a first embodiment of the present invention. As shown, subsequent to start of the engine and initialization of the system at step A001 the coolant temperature is determined by sampling the output of temperature sensor 222 at step A002. In the event that the coolant temperature is below a predetermined level which in this case is selected to be 20° C., the control program flows to step A003 wherein the temperature of the coolant is again sampled. In this event until the coolant temperature comes up to 80 ° C. the program recycles. On the other hand, in the event that the temperature of the coolant is above 20° C. in step A002, then at step A004 the determination is made as to whether the temperature of the coolant is above or below 60° C. In the event that the temperature is between 20 and 60° C. then a non-condensible matter purge sub-routine is run in step A005. However, if the temperature is above 60° C. then the program by-passes the purge operation and proceeds directly to step A006 on the assumption that as the temperature of the coolant at the time of engine start up was above 60° C., the engine has not been idle long enough for air or the like to have leaked into and contaminated the cooling circuit of the engine.

The non-condensible matter purge routine is such as to condition valve 240 to assume an open condition, valve 232 to close and valve 234 to establish flow path A. With the system thus conditioned, pump 222 is operated in the second flow direction for a predetermined period of time (e.g. 10 seconds) to induce coolant from reservoir 228 and pump same into the lower tank 218. As valve 240 is open at this time any excess coolant forced into the cooling circuit overflows along with any non-condensible matter back to the reservoir via overflow conduit 238.

At step A006 a warm-up/displacement mode of operation is entered. During this routine any excess coolant which has entered the cooling circuit while the engine was stopped will be displaced until (a) the coolant boils at a temperature which is deemed appropriate for the instant mode of engine operation or (b) a minimum amount of coolant (viz., the coolant in the coolant jacket 206 and lower tank 214 both assume level H1 and H2 respectively) is retained in the cooling circuit.

During this mode as the coolant is not circulated through the radiator 210 very little heat is lost from the system and the coolant quickly heats to the point of producing coolant vapor. As the pressure rises within the cooling circuit the coolant contained therein is displaced back out to the reservoir 228 via conduit 230 (valve 232 being conditioned to assume an open condition at this time). However, it is possible for be displaced in a manner wherein the level of coolant in the radiator 210 reached level H2 before the level of coolant in the coolant jacket 206 drops to level H1; and in a manner wherein the level H2 is reached before the level of coolant in the radiator lowers to level H2. Accordingly, it is necessary to monitor the outputs of both level sensors 224 and 270 so as to avoid the situation wherein an overdisplacement of coolant occurs leaving the system with less then than a minimum of coolant therein (the minimum quantity of coolant being defined when the level of coolant in the coolant jacket and the radiator are at levels H1 and H2 respectively).

It should be noted that when the engine is stopped and has assumed a predetermined condition (i.e. the system is cooled by continued fan operation until atmospheric pressure or a slightly sub-atmospheric pressure prevails in the cooling circuit) under the control of a "shut-down" control routine (discussed hereinlater in connection with FIG. 23), that liquid coolant from the reservoir 228 is permitted to be introduced into the coolant circuit under the influence of the pressure differential which develops as the coolant vapor condenses to its liquid state. Accordingly, depending on the temperature of the coolant and the amount of coolant vapor which is present in the cooling circuit, the latter will tend to be partially to completely filled with liquid coolant.

Following the coolant displacement the control program flows to step A007 wherein the operation of the fan 248 is controlled in a manner to maintain the temperature of the coolant in the coolant jacket 206 at a level which is deemed to be most appropriate for the instant set of engine operational conditions.

At step A008 a pump control routine is implemented in order to maintain the level of coolant in the coolant jacket at H1. Following this the temperature of the coolant is determined in step A009 and ranged in a manner that if within a range of target +2.0° C. to target −4.0° C., then the program flows back to step A007. However, if the temperature is lower than target −4.0° C., then at step A010 a routine which increases the level of coolant in radiator 210 is implemented while if the temperature is greater than target +2.0° C. then at step A011 the level of coolant in the lower tank 214 is determined by sampling the output of level sensor 270. In the event that the level of coolant in the lower tank 214 is above H2 then the program proceeds to step A012 wherein a radiator level reduction control routine is run. However, if the outcome of the enquiry carried out at step A011 indicates that the level of coolant is not above H2 then the program recycles to step A007.

SYSTEM INITIALIZATION ROUTINE

(All Embodiments)

Figure 12:
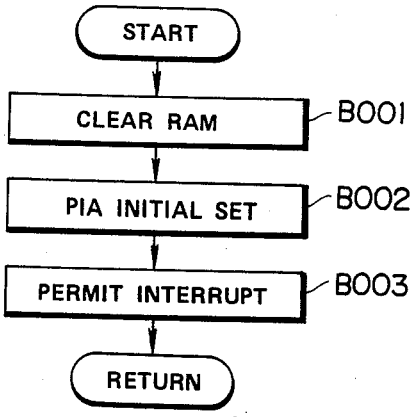

FIG. 12 shows the steps which are executed from the time the engine is started and power is supplied to the control circuit 226. As shown, the first step E001 of this routine is such as to clear the RAM of the control circuit microprocessor of any residual data or the like that may be contained there so as to clear the way for error free processing of any programs that are subsequently run. At step B002 the peripheral interface adapter is set and in step B003 the system conditioned so as to permit interrupts to be carried out.

INTERRUPT ROUTINE (All Embodiments)

This routine (FIG. 13) is run at predetermined intervals so as to frequently determine the current status of the engine. That is to say, determine whether the engine running or not and if it necessary to stop normal control and enter a shut-down control mode which controls the cool down of the engine in a manner which prevents the phenomenon wherein superatmospheric pressures within the cooling circuit tend to displace coolant out of the cooling circuit with such violence that coolant is lost via spillage and/or air permitted to enter the system in large amounts.

COLD NON-CONDENSIBLE MATTER PURGE CONTROL ROUTINE (First and Second Embodiments)

This control routine (FIG. 14) is implemented in the first and second embodiments of the present invention. The object of this routine is to rid the cooling system of any air or the like non-condensible matter which might have collected in the system prior to the beginning of the distillation process wherein coolant vapor produced in the coolant jacket is transferred to the radiator for condensation and thus prevent the formation of any air embolisms in the radiator which drastically reduce the efficiency thereof.

As shown, the first step of this routine (D001) is such as to condition the three valves of the system shown in FIG. 8 of the drawings in a manner such that valve 240 is opened to establish communication between the riser 214 and the reservoir via overflow conduit 238, valve 234 is conditioned to produce flow path A and valve 232 is closed.

In connection with the disclosure of the first and second embodiments a convention will be used wherein valves 240, 234 and 232 will be referred to as valves I, II and III respectively (viz., in clockwise order as seen in the drawings).

At step G002, pump 222 is energized in the second flow direction so as to induct coolant from reservoir 228 and force same into the lower tank 218. With this mode of coolant introduction, fresh coolant is forced into the system in a manner to firstly flow upwardly through the conduiting of the radiator 210 and thus tend to scavenge out any small bubbles of air or the like that might be adhering to the inner surfaces of the same.

At step D003 a soft clock or "timer 1" is set counting for a predetermined period of time. This period can vary from several seconds to several tens of seconds. Until this period expires the routine is forced to loop as shown. When the time expires the pump is stopped (step D004) and timer 1 cleared (D005).

It will be noted that this routine is referred to as a "cold" purge so as to differentiate it from the "hot" purges of the second and third embodiments which are effected in response to abnormally high temperatures within the cooling circuit.

WARM-UP/DISPLACEMENT CONTROL ROUTINE (First and Second Embodiments)

Figure 15:
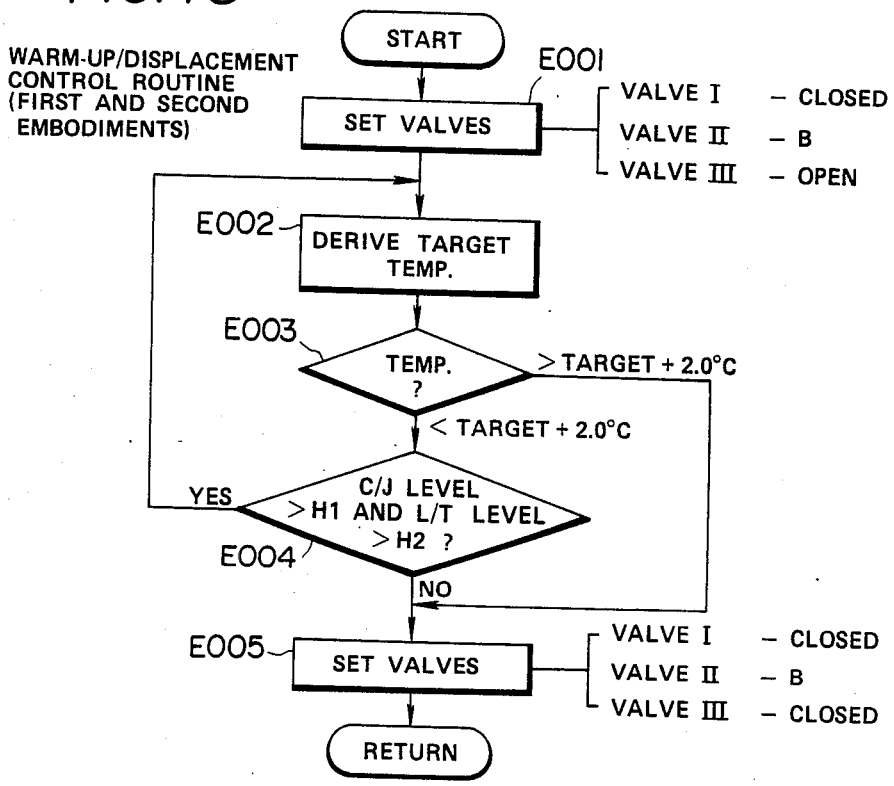

FIG. 15 shows the control routine which is executed in the first embodiment in order to remove sufficient coolant from the cooling circuit of the engine so as to enable the coolant temperature to be brought to a level deemed most appropriate for the instant set of operating conditions.

The first step of this control is such as to condition valves I, II and III in manner that valve I is closed, valve II establishes flow path B and valve III is open to permit coolant to be displaced out to reservoir 228. At step E002 the "target" temperature to which the coolant should be controlled is derived.

As will be clear from the discussion of FIG. 5 by sampling the outputs of load and speed sensors 271 and 272 it is possible either by table look-up or by using a suitable program to determine which zone the engine is operating and which temperature is most suited to the instant set of operating conditions. As the various techniques via which this value can be derived will be obivous to those skilled in the art of programming no further discussion of same will be given for brevity. However, as will be appreciated a given temperature may be selected for each of the zones or the temperature varied within each of the zones as deemed appropriate for the given engine and/or vehicle in which the engine is mounted.

At step E003 the output of the temperature sensor 268 is sampled and ranged against the value derived in step E002. In the event that the instant coolant temperature is below the target value by 2.0° C. (by way of example) it is necessary to stop the displacement of coolant from the system and the program flows to step E005 wherein the system is placed in a hermetically closed condition. Viz., if the temperature is low, the possibility that the surface area of the radiator 210 available for heat exchange has increased to the point where, due to very low ambient temperatures for example, the rate of condensation therein is exceeding that at which the target temperature can be maintained. On the other hand, if the temperature is found to be greater than target by the same amount (for example) then it is deemed that the radiator is still partially filled with coolant and insufficient heat exchange surface area is yet available. In order to ascertain this fact, the ouputs of both level sensors 224 and 271 are sampled in step E004. In the event that both levels are above the respective minimum ones (viz., H1 and H2) it is deemed safe to permit coolant to continue to be displaced out of the system under the influence of the vapor pressure being generated therein and the program recycles to step E002. However, if either of the levels in the coolant jacket 206 and radiator 210 have fallen to H1, or H2 then in order to prevent the possibility of overdischarging coolant and leaving same short of the same, the program goes to step E005. As previously pointed out the minimum amount of coolant with which the system can safely operate is defined when levels H1 and H2 are simultaneously reached.

TEMPERATURE CONTROL ROUTINE (First and Second Embodiments)

Figure 16:
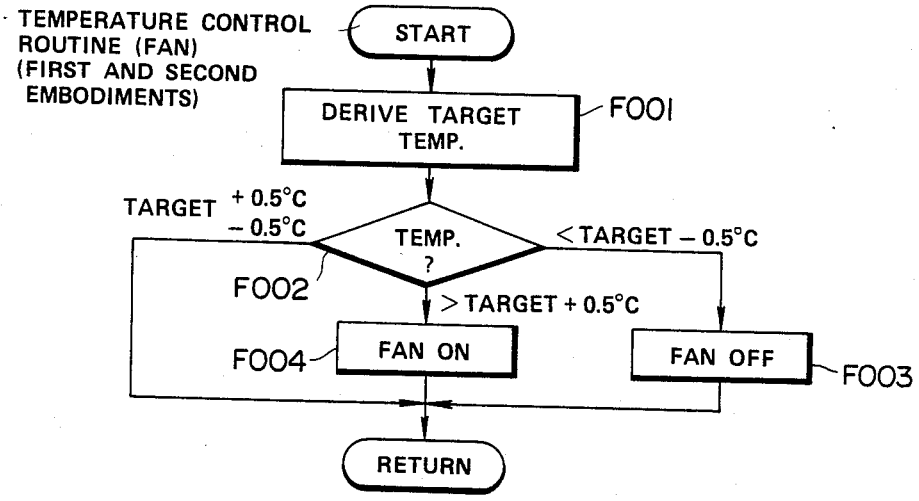

FIG. 16 shows a control routine which is used to operate the cooling fan 216 of the arrangement shown in FIG. 8 of the drawings in a manner which tends to bring the temperature of the coolant to the desired target level. In step F001 the target value is derived so as to ensure accurate temperature control. At step F002 the target value is ranged against the instant temperature and, in the event that the temperature of the coolant is above derived in the previous step by small amount (in this case 0.50° C.) a command to energize fan 216 is issued in step F003 while in the event that the temperature is below target by the same small amount a command to stop the fan is issued (F004).

The object of this control is to provide "fine" temperature control viz., control over a narrow temperature range varying the amount of heat which is removed from the radiator by the draft of air (cooling medium) which passes thereover.

COOLANT JACKET LEVEL CONTROL ROUTINE (First and Second Embodiments)

Figure 17:
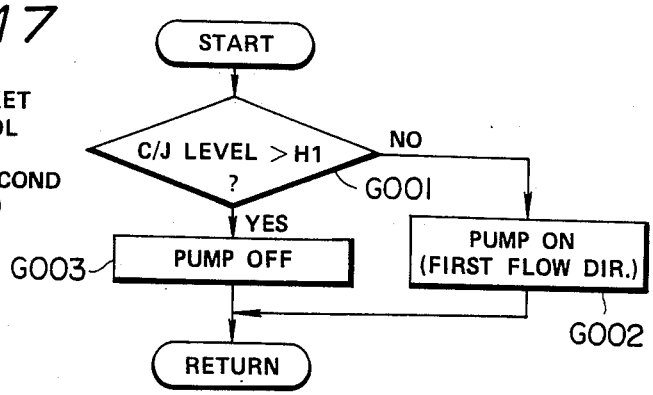

As will be apparent from the flow chart of FIG. 17, this routine simply checks the output of level sensor 268 and switches on coolant return pump 222 each time the level of coolant in the coolant jacket drops below level H1. However, as this control can induce rapid ON/-OFF cycling of pump 222 under certain cirumstances it is possible to arrange for level sensor 268 to exhibit hysteresis and thus slightly prolong pump operation and thus reduce the maximum ON/OFF frequency of the same. Alternatively, as will be readily apparent, by introducing a timer between steps G001 and G002 into the instant program the same effect could be achieved.

RADIATOR LEVEL INCREASE CONTROL (First Embodiment)

Figure 18:
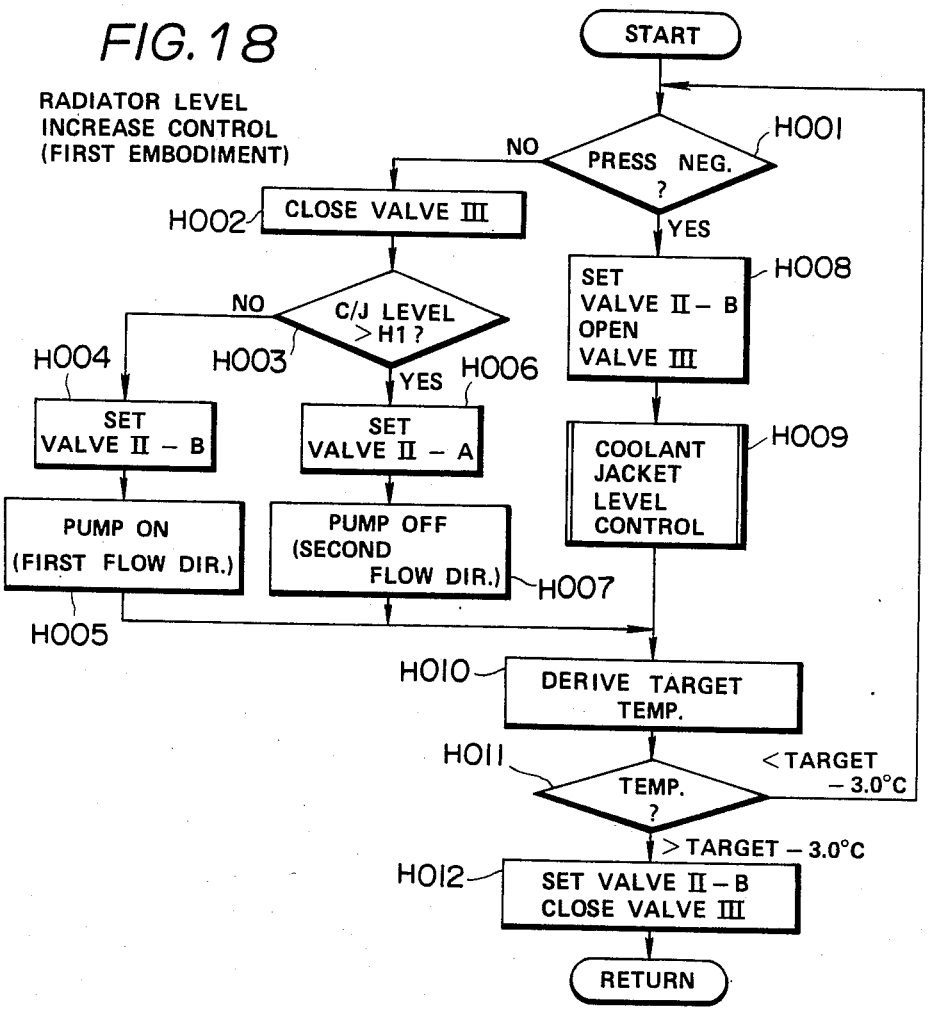

This routine is implemented in response to what shall be referred to as "overcooling" of the engine such as indicated as step A009 of FIG. 11—viz., the temperature of the engine coolant has dropped below target by a relatively large amount (in this case 4.0° C. by way of example) due to extremely low ambient temperatures, prolonged downhill coasting or the like. As shown in FIG. 18 of the drawings the first step K001 of this control is such as to sample the output of the pressure differential responsive switch arrangement 216 and determine if the pressure within the cooling circuit has dropped by a predetermined small amount below atmospheric level. In the event that the outcome of this enquiry indicates that a "positive" pressure is currently prevailing within the system the program goes to step H002 wherein a command to close valve III is issued and thus prevent any undesired displacement of the coolant due to the super-atmospheric conditions.

Following this at step H003, the output of level sensor 268 is sampled and in the event that the level of coolant is not above level H1 then as steps H004 and K005 valve II is conditioned to produce flow path B and pump 222 energized in the first flow direction. Under these conditions coolant is inducted from the lower tank 218 and pumped into the coolant jacket 206. On the other hand, if the outcome of the enquiry conducted in step H003 indicates that the level of coolant in the coolant jacket is above level Hl then it is possible to condition valve II to establish flow path A and energize pump 222 in the second flow direction and thus induct coolant from reservoir 228 and introduce same into the lower tank 218 in a manner that the level of coolant therein is elevated thus reducing the surface area via which heat may be released from the system and simultaneously increasing the pressure prevailing within the system. This measure of course quickly compensates for the "overcooled" condition of the system.

Following this the program flows to step H010 wherein the target temperature is determined and as step H011 the instant temperature compared with the just derived target value. This of course detects the effect that the control in preceeding steps have had. In the event that the instant temperature is still below target by 3.0° C. then the program recycles to step H001 while if the temperature has been raised by a given amount toward the target value by predetermined amount (in this case 1.0° C.) the program goes to step H012 wherein the system is switched back to a "normal" state ready for entry into the next control phase.

However, if the outcome of the enquiry conducted at step H001 indicates that the pressure within the cooling circuit is in fact negative, then at step K008 the system is conditioned so that coolant can be inducted into the lower tank 218 via conduit 230 while flow path B is maintained thus facilitating the execution of the coolant jacket level control routine in step K009. Under these conditions the level coolant in the radiator 210 is permitted to increase under the influence of the negative pressure as different from the positive introduction performed in steps H006 and H007.

RADIATOR LEVEL REDUCTION CONTROL (All embodiments)

Figure 19:
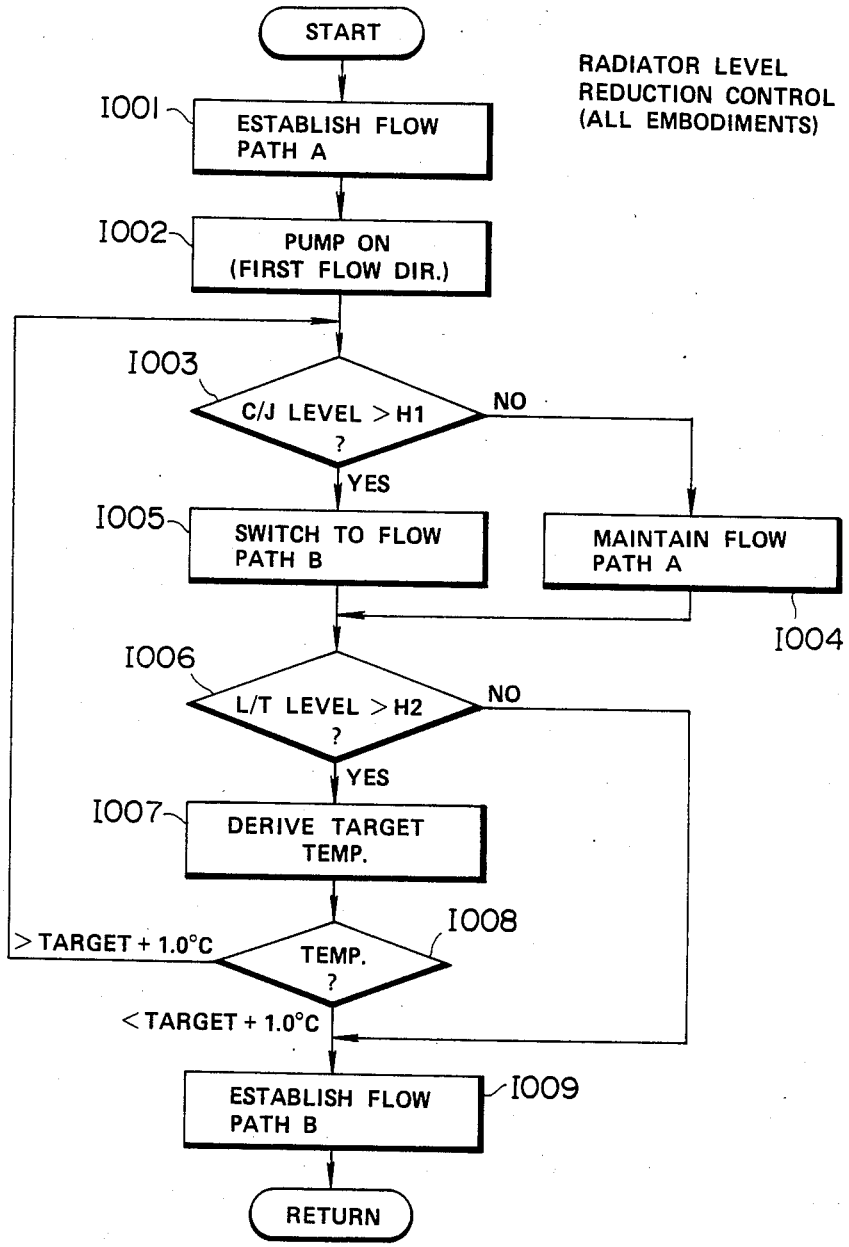
Figure 20:
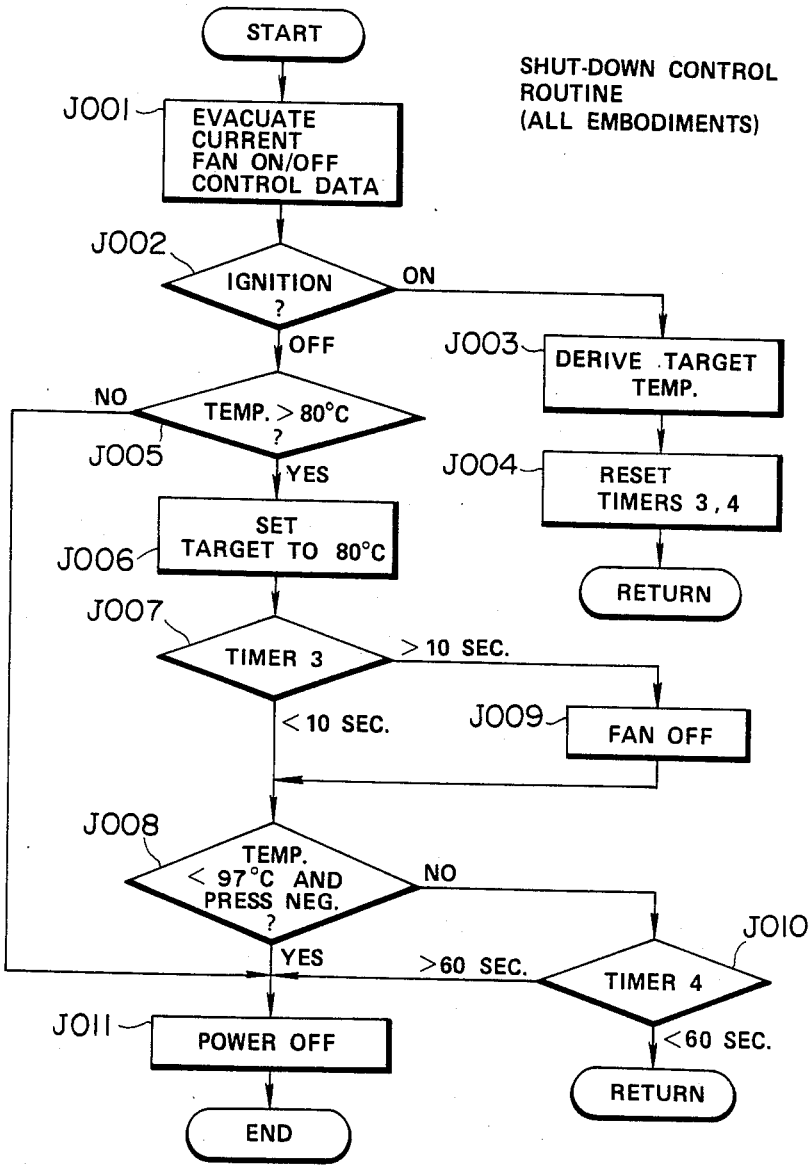

In the event that the temperature of the coolant is above the target level by a relatively large amount such as 2.0° C. o step A009 of the control system routine (see FIG. 11) and the level of coolant in the lower tank 218 is above level H2 then it is possible to control the coolant temperature by removing some of the coolant contained in the cooling circuit in a manner which increases the surface area of the radiator 210 available for latent heat of evaporation heat release and simultaneously lowering the pressure prevailing therein. The routine which controls this mode of operation is shown in FIG. 19 and is common to all embodiments.

The first step of this control (step I001) is such as to condition valve II (234) to produced flow path A and thus establish communication between the radiator 210 and the reservoir 228. At step I002 pump 222 is energized in the first flow direction to pump coolant out of the lower tank 218 to the reservoir 228 via conduit 236.

At step I003 the level of coolant in the coolant jacket 206 is checked and if above level H1 the program flows to step I004 wherein the instant set of valve conditions are maintained to permit further coolant removal. However, in the event that the level of coolant in the coolant jacket 206 is lower than H2 then it is necessary to re-establish communication between the lower tank 218 and the coolant jacket 206 and subsequently pump coolant from the former into the latter. This of course also reduces the level of coolant in radiator 210. At step I006 the output of level sensor 270 is sampled and in the event that level of coolant is still above level H2 then the program flows to step I007 wherein the target temperature is derived in preparation for the temperature ranging which is carried out in step I008. However, if the outcome of the enquiry conducted in step I006 indicates that the level of coolant in the lower tank 218 has fallen to the minimum level H2 then steps I007 and I008 are by-passed and at step I009 valve II conditioned to produce flow path B.

In the temperature ranging of step I008 if the temperature is still above target by 1.0° C. then the program recycles in order to induce further pressure and liquid coolant level reductions. However, if the measures executed by this routine have brought the instant coolant temperature to within 1.0° C. of the desired value then the program goes to step I009 and subsequently returns.

SHUT-DOWN CONTROL ROUTINE (All Embodiments)

Figure 13:
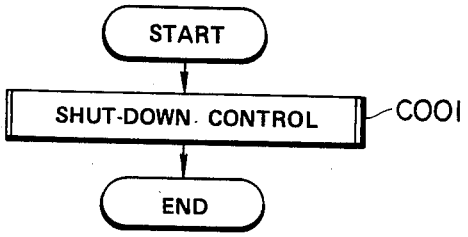
Figure 14:
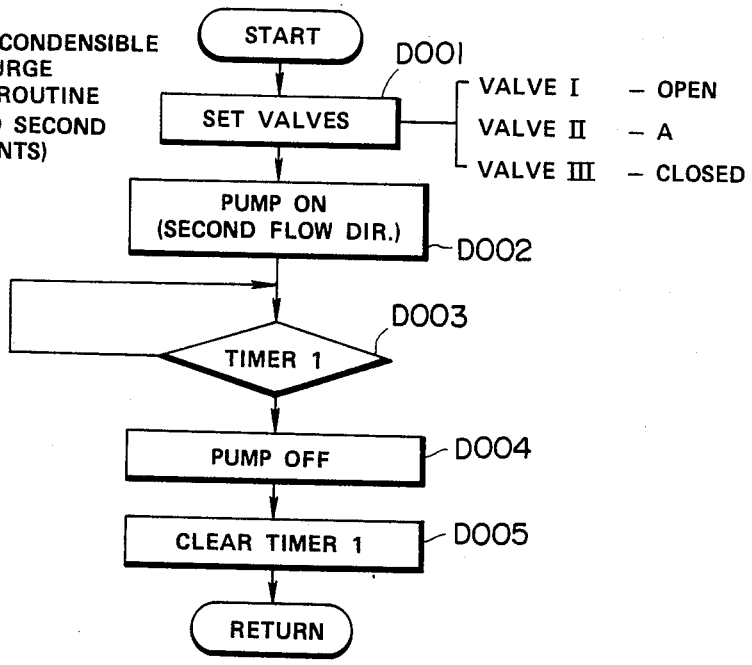

This control is executed in response to each run of the interrupt routine (FIG. 13). As shown, the first step of this routine (step J001) evacuates the current fan ON/-OFF control data from the microprocessor CPU. Following this the current status of the engine ignition is determined at step J002. This may be done by sampling the ON/OFF status of the ignition switch or the zero output of an engine speed sensing device such as the engine distributor, crankshaft rotational speed sensor or the like.

In the event that the engine ignition is detected as still being ON then the program goes to step J003 wherein the target temperature is determined. Following this at step J004, a command to reset timers 3 and 4 (used in the cool-down flow) is issued in step J004 and the program returns. However, if the outcome of the enquiry conducted as step J002 indicates that the engine is stopped then at step J005 the instant coolant temperature is sampled and ranged against a preset value which in this case is selected to be 80° C. If the temperature is detected as being below 80° C. then the program flows directly to step J011 wherein the supply of power to the whole system is terminated. However, while the temperature is still above 80° C. the program is switched to flow through steps J006 to J010. In this part of the routine the target temperature is set to 80° C. and timer 3 is set counting. In this embodiment timer 3 is arranged to count over a period corresponding to 10 seconds. As shown, until this period expires the program is forced to flow through step J008 wherein the outputs of the temperature sensor 268 and the pressure differential sensor 216 are both sampled. In the event that the temperature is found to be below 97° C. and the pressure in the cooling circuit, sub-atmospheric then it is permissible to de-energize the system and allow communication between the reservoir 228 and the lower tank 218 whereby the coolant in the reservoir can be inducted into the cooling circuit under the influence of atmospheric pressure. However, in the event that both of these requirements are not simultaneously met then timer 4 is set counting over a period of 60 seconds. While the count is below 60 seconds the program is returned. Thus, as will be appreciated the system will be maintained operational to watch the condition of the same until either a one minute period has expired or the temperature is detected below 80° C., or the temperature and pressure are found to be simultaneously below 97° C. and negative, respectively. This of course ensures that any violent discharge of coolant will not invite loss of coolant and/or entry of air into the system.

SECOND EMBODIMENT

The second embodiment of the present invention overcomes the cold coolant introduction problems encountered with the arrangement shown in FIG. 7 of the drawings by actually sampling the ambient temperature and if below a preselected minimum value terminating the radiator coolant level increase control which tends to pump (very) cold coolant into the radiator in an effort to raise the temperature and pressure prevailing in the system. Viz., under extremely cold circumstances once the just mentioned routine is entered, the possibility exists that the introduction of the very cold coolant from the reservoir 228 will offset the temperature increase function it is supposed to perform and induce a kind of short circuit in the control which will continue the introduction beyond the point wherein the system is completely filled with coolant even to the point of bursting same by overfilling. Viz., as the control is controlled in response to temperature rather than pressure, as long as the temperature does not rise the control circuit continues to assume that the radiator is still not sufficiently filled as to reduce the effective heat exchange surface area thereof and maintains the control which pumps coolant in from the reservoir.

It will be noted that as a discussion of the flow charts shown in FIGS. 12 to 17 and 19–20 have been made in connection wth the first embodiment no further description will be given and that only the routines which are peculiar to the second embodiment discussed in detail.

SYSTEM CONTROL ROUTINE (Second Embodiment)

Figure 21:
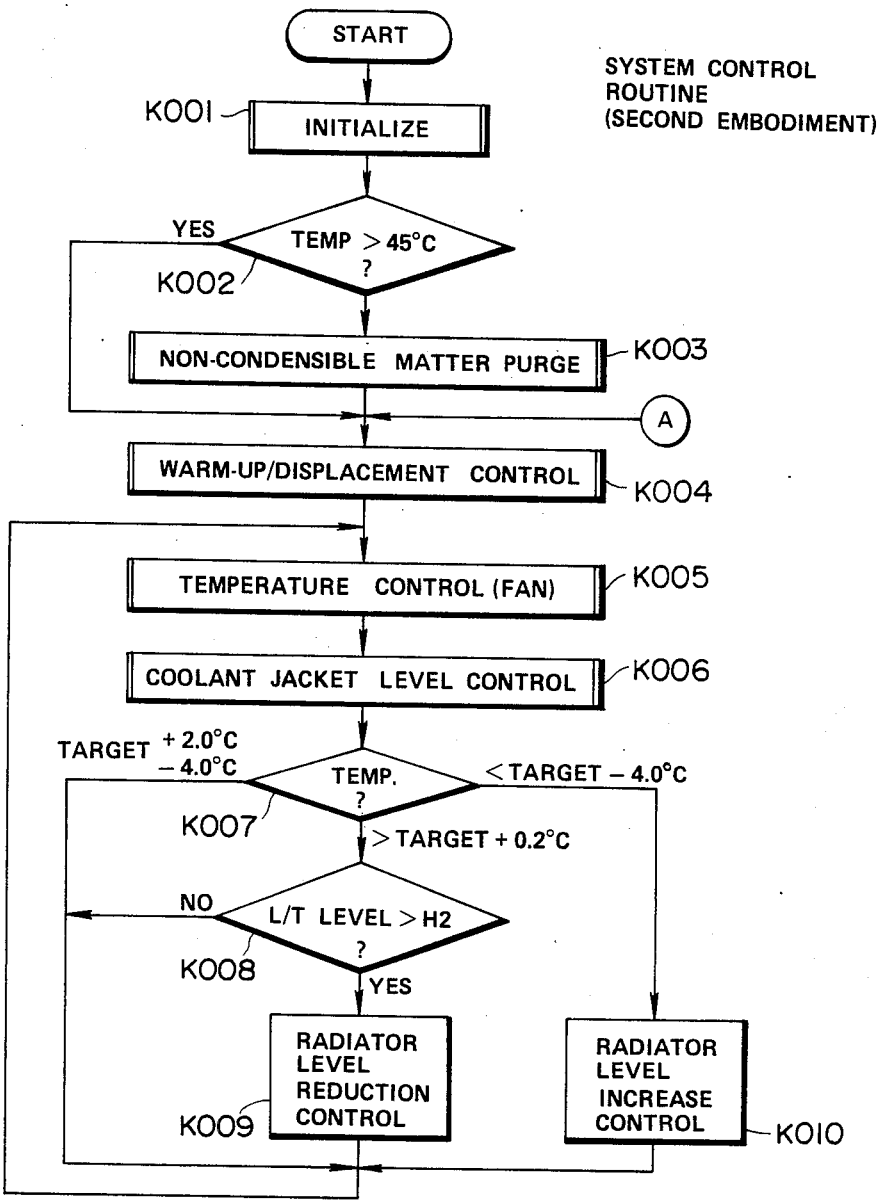

FIG. 21 shows the steps which characterize the overall control of the second embodiment. As will be noted this routine is essentially the same as that shown in FIG. 11 save the simplification in the initial temperature detection steps. As will be readily appreciated steps K001 to K010 correspond essentially to steps A001, A002 and A005 to A012. Accordingly, a detailed description of same will not be given. However, it will be appreciated that it is possible for the flow chart of FIG. 11 to be substituted for that of FIG. 21 if it is so desired.

RADIATOR LEVEL INCREASE CONTROL ROUTINE (Second Embodiment)

Figure 22:
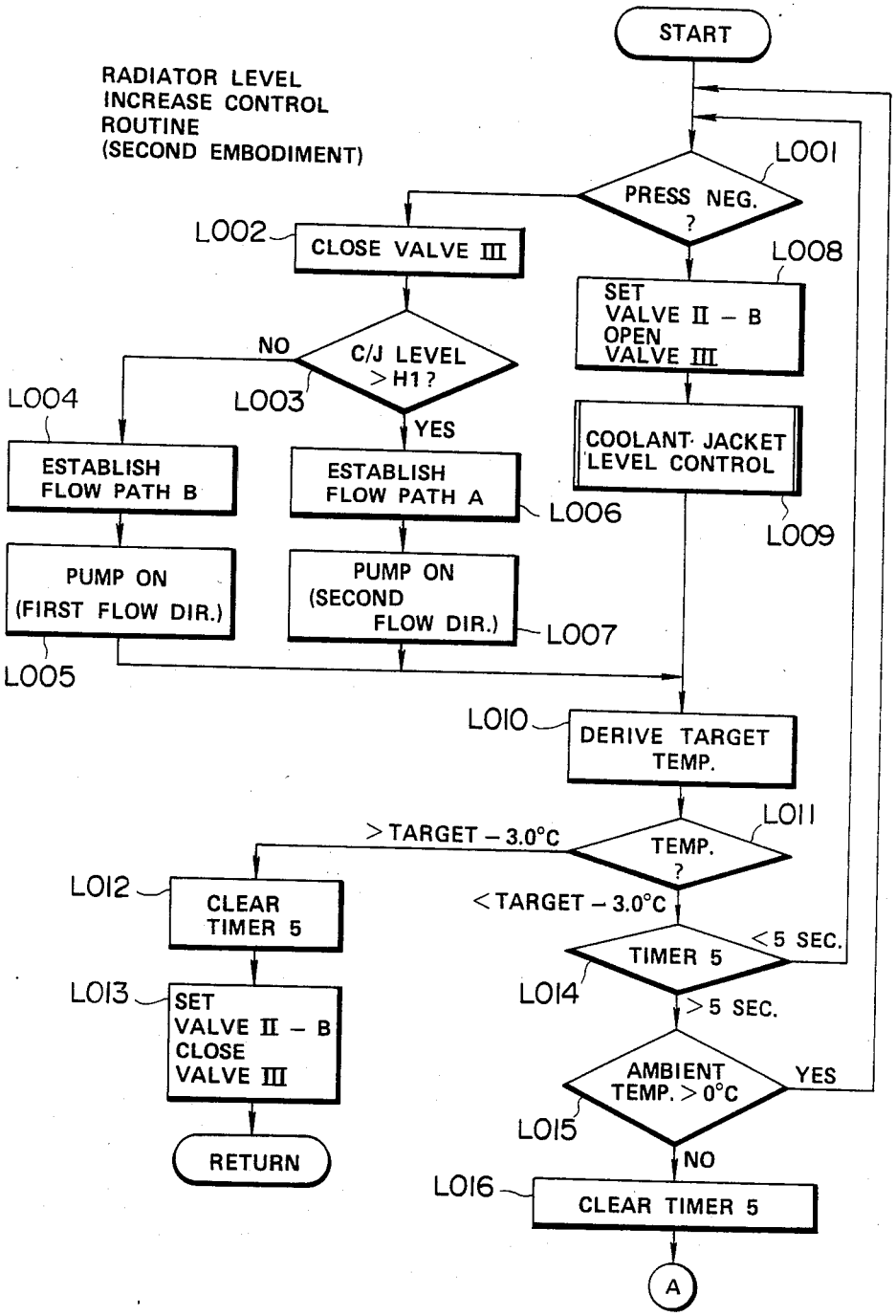

Steps L001 to L011 of the routine shown in FIG. 22 correspond exactly to steps H001 to H012 of the routine shown in FIG. 21. Accordingly, a redundant description of the same will be ommited.

At step L011 if the temperature of the coolant is detected to be greater than the target value minus 3.0° C. then the program flows to step K012 wherein a soft clock "timer 5" is cleared and thereafter goes to step L013 wherein valve II is conditioned to provide flow path 5 and valve III closed. On the other hand, if the outcome of the enquiry at step L001 indicates that the temperature of the coolant is less than the target value by 3.0° C. then timer 5 is started. While the count of this clock remains within 5 seconds the program is directed back to step L001. However, in the event that this program is in use for more than 5 seconds at step L015 the output of ambient temperature sensor 280 is sampled. In the event that the ambient temperature is above a predetermined low value, in this case 0° C., then it is assumed that the lengthy use of particular control is not due to the introduction of very cold coolant into the system and the program is permitted to recycle to step L001. On the other hand, if the ambient temperature is found to be lower than the minimum allowable limit, then the program is directed to flow out of this routine (via step L016 wherein timer 5 is cleared) back to step K004 (see FIG. 12) on the assumption that, as the ambient temperature is very low, the reason for the prolonged filling of the radiator 210 is more than likely due to same.

THIRD EMBODIMENT

Figure 9:
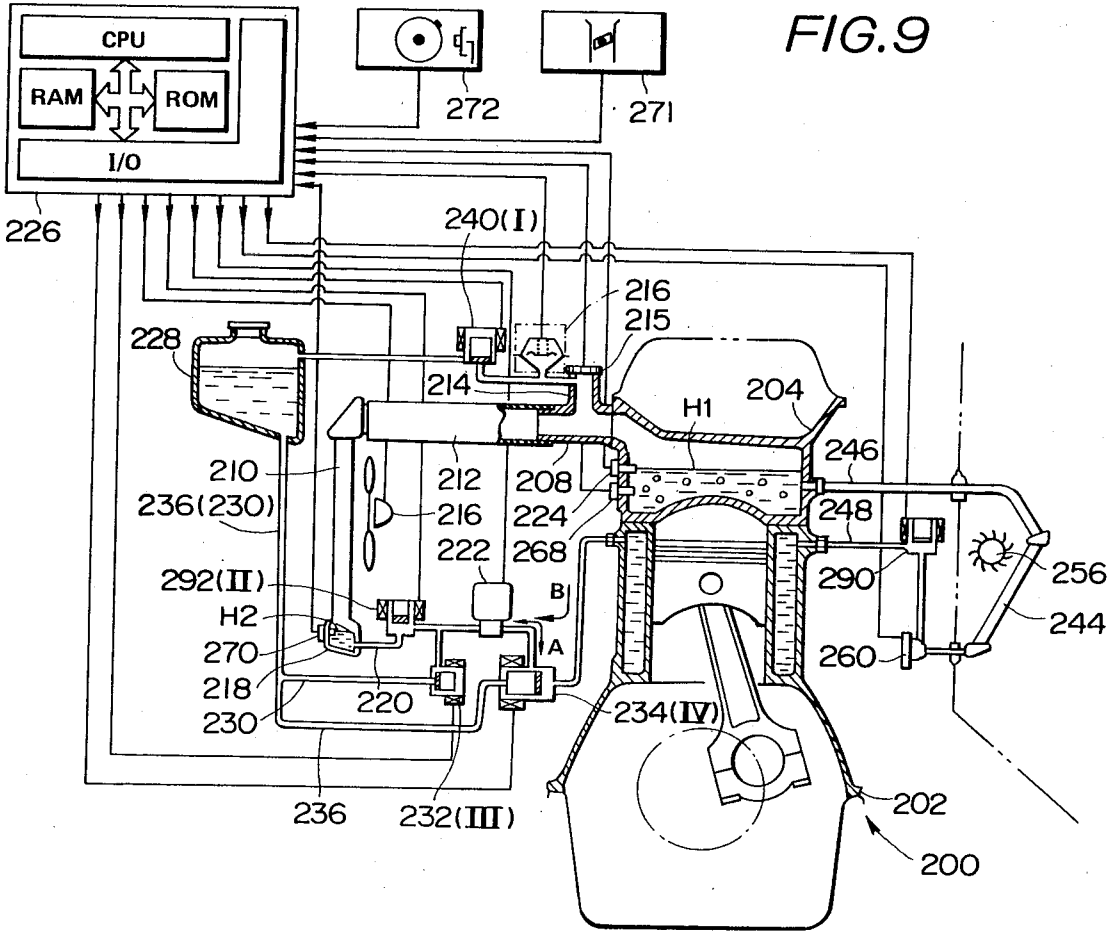
FIG. 9 shows an engine system to which a third embodiment of the present invention is applied.

FIG. 9 shows an engine system to which a third embodiment of the present invention is applied. This system differs from the one shown in FIG. 8 in that an on/off type valve 290 is introduced into conduit 248 to enable complete circulation cut-off of the heated coolant from the coolant jacket through the core 244 of the cabin heater and further (and more importantly) by the introduction of a fourth valve 292 into the valve and conduit arrangement which controls the communication between the cooling circuit and the reservoir 228. As the operation of the valve and conduit arrangement will become clear hereinlater with reference to the flow charts which depict the steps which characterize the operation of same, no further disclosure will be made at this point for the sake of brevity.

In brief, this embodiment is characterized in that in order to speed up the warm-up of the engine, the "cold purge" which is executed in the first and second embodiments is omitted completely and instead a radically different approach made. That is to say, in this embodiment, valve I is opened during engine warm-up in a manner to permit air to be inducted into the cooling circuit and the remaining valve and conduit arrangement conditioned in a manner wherein, upon energization of pump 222, coolant is forcefully pumped out of the system. As will be appreciated the fact that valve I is open obviates the formation of a negative pressure which not only interferes with the coolant boiling point control but also invites crushing of the cooling system components.

Following the engine warm-up, the air which is inducted into the system is purged out using what shall be termed "hot purges" upon the increasing above the desired level.

SYSTEM CONTROL ROUTINE (Third Embodiment)

Figure 23:
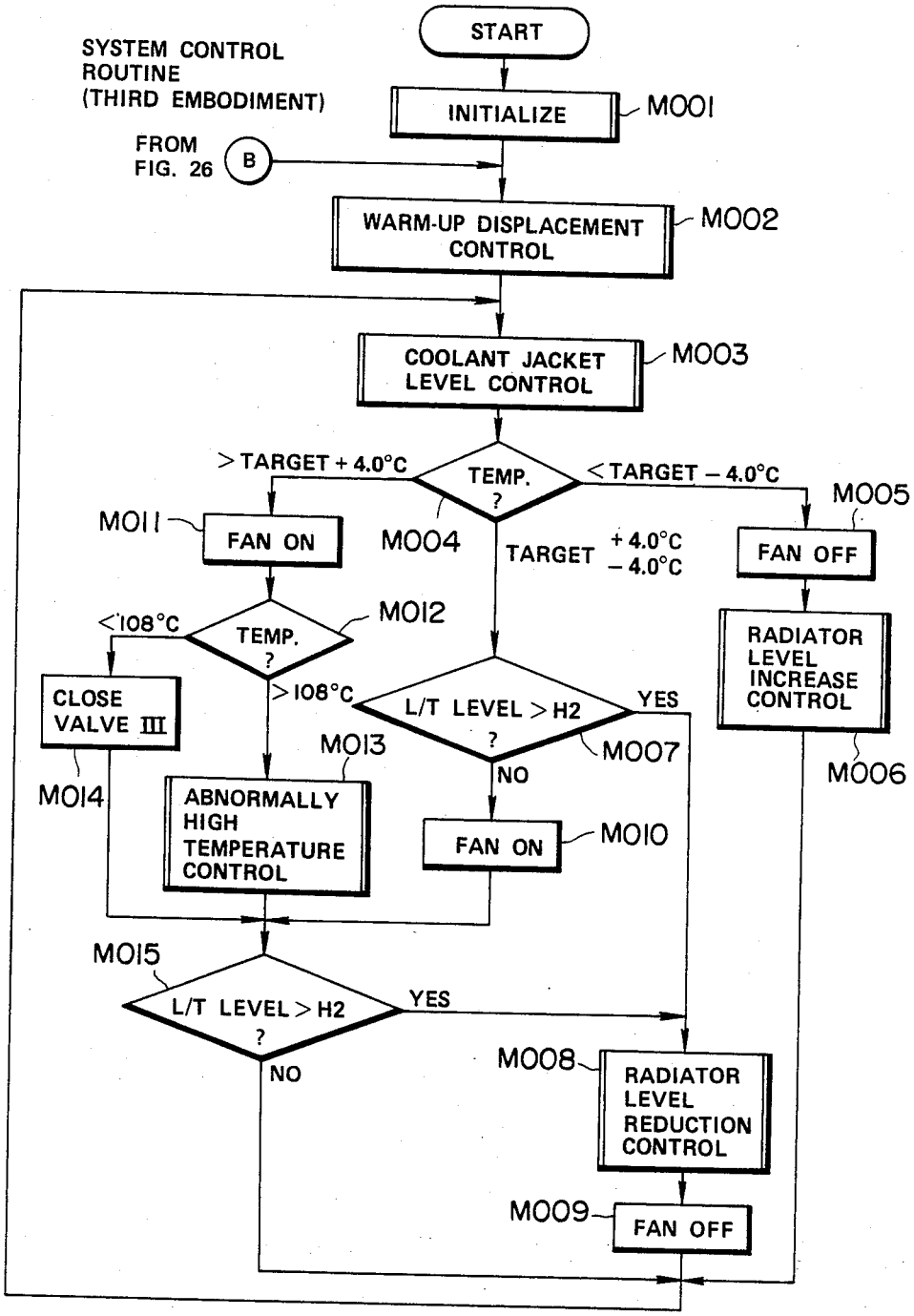

As shown in FIG. 23 following initialization of the system in step M001, a warm up/displacement control routine is directly entered at step M002. Following this, a coolant jacket level control routine is run in step M003 whereafter at step M004 the output of temperature sensor 268 is sampled and ranged against the target temperature which by this time has been determined as a result of one of the frequently run interrupt and subsequent shut-down control routines—see for example step M003 in FIG. 20.

In the event that the coolant temperature is found to be low (less than target −4.0° C.) the program proceeds to steps M005 and M006 wherein a command to stop the operation of fan 216 is issued and a radiator level increase control routine run. However, if the coolant temperature is within a range of target +4.0° C. to target −4.0° C. then at step M007 the output of level sensor 270 is sampled. In the event that the level of coolant in lower tank 218 is above level H2 then the program goes to step M008 wherein a radiator level reduction control routine (such as disclosed hereinbefore in conjunction with FIG. 19) is run. At step M009 a command to stop the operation of fan 216 is issued.

However, if the outcome of the enquiry conducted at step M007 indicates that the level of coolant in the lower tank 218 is not above H2 then at step M010 a command to start fan 216 is issued.

On the other hand, if the temperature of the coolant is found to be on the high side in step M004 (viz., above target +4.0° C.) then at step M011 fan 216 is energized and at step M012 the instant coolant temperature ranged against a preselected high level which in this case is selected to be 180° C. In the event that the coolant temperature is above this level then an abnormally high temperature control routine is implemented (step M013) while in the event that the coolant temperature is below this level valve III is closed at step M014.

Following steps M010, M013 and M014 the output of level sensor 270 is sampled (step M015). If the level of coolant in the lower tank 218 is found to be above level H2 then the program proceeds to step M008 while if not above the same, the program loops back to step M003.

WARM-UP/DISPLACEMENT CONTROL ROUTINE (Third Embodiment)

At step N001 the instant coolant temperature is sampled and compared with a fixed value of 80° C. In the event that the coolant temperature is above 80° C. then the program flows into a first stream of steps N002 to N005. In this stream the valve and conduit arrangement is conditioned as shown. Viz., the system is conditioned to assume a closed circuit condition wherein communication between the lower tank 218 and the coolant jacket 206 is established via valve 292 (valve IV) pump 222 and valve II. It should be noted that the valves in the FIG. 9 arrangement are labelled I–IV in a counter clockwise direction as seen in the figure. Viz., valves 240, 292, 232 and 234 become valves I, II, III and IV, respectively.

At step N003 the output of the pressure differential sensor 216 is sampled and in the event that the pressure is negative the program returns, while in the event that the pressure is not subatmospheric then at step N004 the instant coolant temperature ranged against the target value. As shown, if the temperature is on the low side then at step N005 a coolant jacket level control routine is implemented.

On the other hand, if the coolant temperature is detected as being below 80° C. at step N001 then the program enters a second stream beginning with step N006 wherein the output level sensor 224 is sampled. If the outcome of this enquiry indicates that the level of coolant in the coolant jacket is above level H1 then the program proceeds to step steps N007 and N008 wherein the system is conditioned such that the operation of the pump in the second flow direction inducts coolant from the coolant jacket 206 and forces same out to the reservoir via conduit 236. This state is maintained until such time as the level of coolant in the coolant jacket reaches the desired level H1. It should be noted that as valve I is open at this time air is permitted to enter the cooling circuit and thus offset any tendency for a negative pressure to develop as a result of the coolant being positively pumped out of the system. Upon the level H1 being reached the operation of the pump 222 is stopped and the system conditioned as shown in step N010 so as to render the system open circuit so as to permit further displacement of coolant under the building vapor pressure (note that valve I is closed) and monitor the level of coolant in the coolant jacket 206. When the level of coolant in the coolant jacket drops below H1 the output of level sensor 270 is sampled to determine whether the level of coolant in the lower tank 218 is above level H2. In the event that the level is still above H2 then at step N013 valve III is closed so as to place the system in a closed circuit state and at step N014 pump 222 is energized in the first flow direction. This inducts the excess coolant from the lower tank and directs it into the coolant jacket. When the level of coolant in the coolant jacket is replenished, the program flows to step N015 wherein a command to stop the operation of the pump is issued.

However, in the event that the enquiry conducted at step N012 indicates that the level of coolant in the coolant jacket is not above H2 then at step N016 the valve and conduit arrangement is condition as shown. In this state when the pump 222 is energized in step N017 coolant will be inducted from the reservoir via conduit 230 and open valve II and directed into the coolant jacket 206. As valve I is open at this time the pressure within the cooling circuit remains at atmospheric. This operation terminates upon the level of coolant in the coolant jacket being raised to level H1.

At step N019 the instant temperature of the coolant is determined. In the event that the latter is still on the cold side, viz., lower than 80° C. then the program recycles to step N010. However, if the temperature is above 80° C. then the program flows across to step N002 wherein the system is conditioned for "normal" coolant jacket-radiator-coolant jacket "distillation-like" coolant circulation.

As will be appreciated, the above described routine is such as to positively pump coolant out of the system until such time as the levels in the coolant jacket 206 and the radiator 210 have fallen to levels H1 and H2, respectively. This of course minimizes the amount of the coolant that must be heated during engine warm-up in cold weather and completely avoids the problems encountered in the event that very cold coolant is pumped into the system as a matter of course each time the engine is subject to a cold start.

COOLANT JACKET LEVEL CONTROL (Third and Fourth Embodiments)

Figure 24:
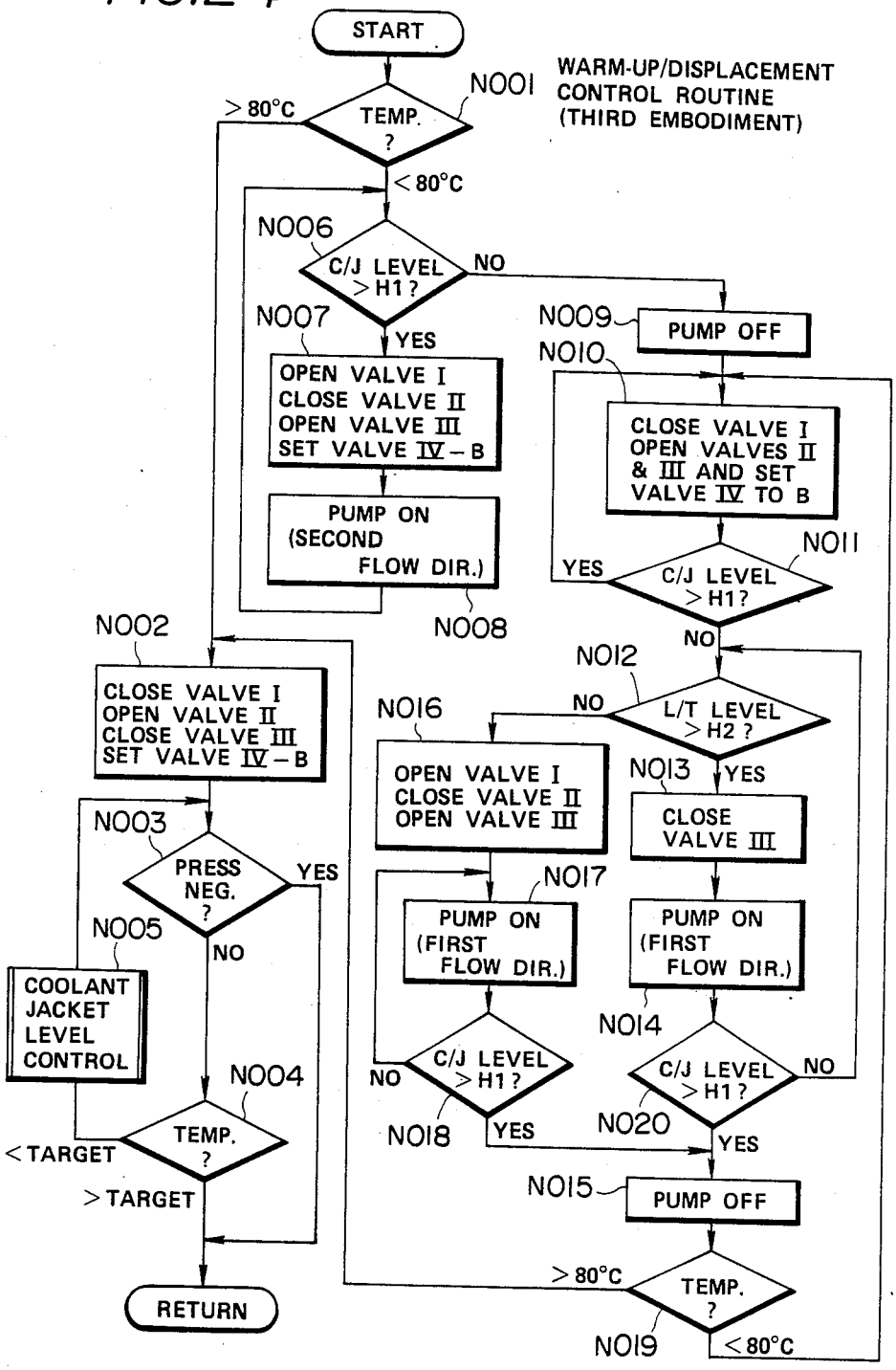
Figure 25:
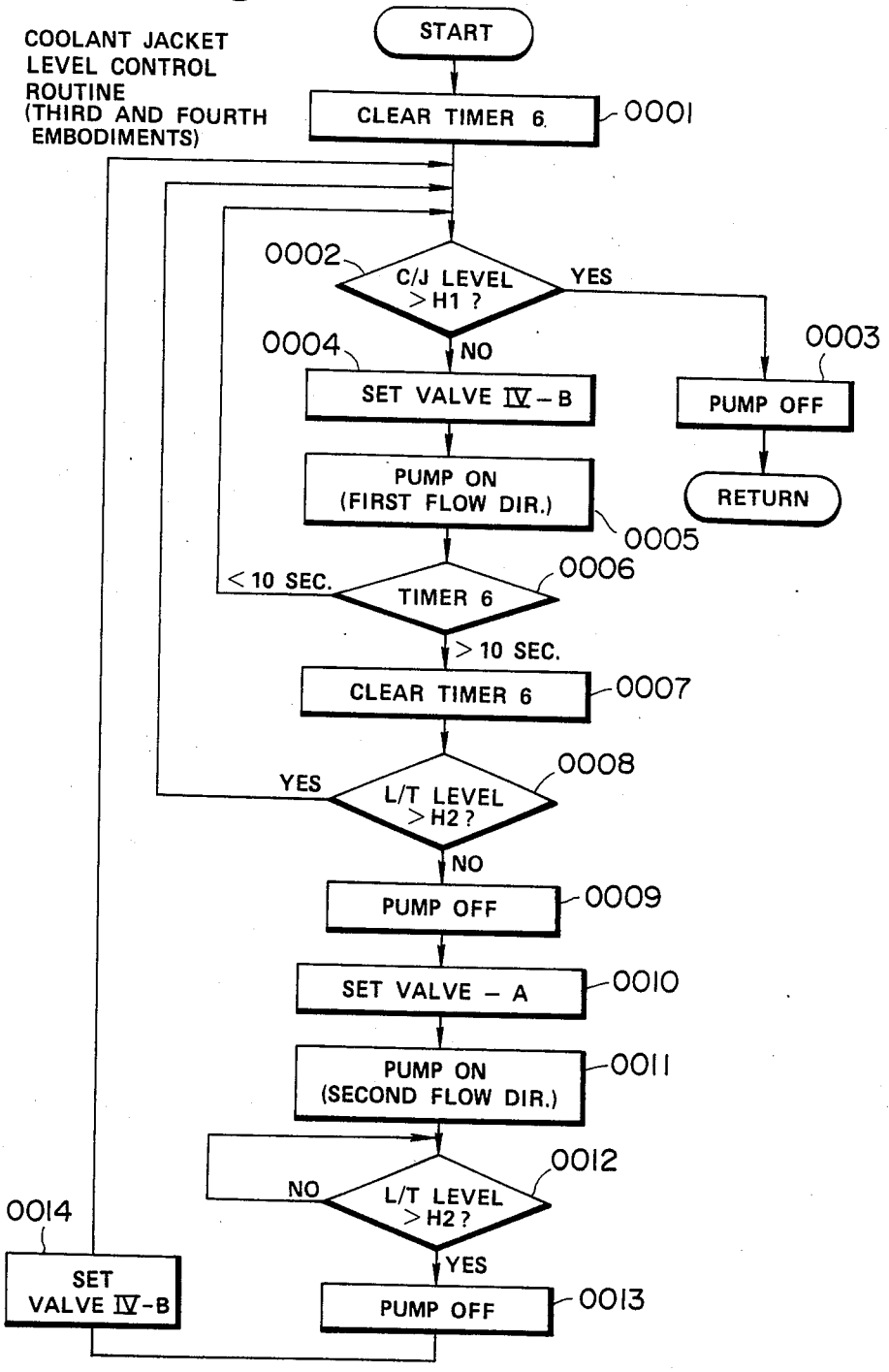

FIG. 25 shows the steps which are performed each time the control routine of FIG. 24 goes to step N005.

As shown, the first step of this control is such as to clear a soft clock or timer 6 ready for holding the operation of the pump on for a period which in this instance is selected to be 6 seconds. At step 0002 the level of coolant in the coolant jacket 206 is checked and if above H1 the program proceeds to step 0003 wherein a command to stop the operation of pump 222 is issued. However, if the level of coolant is found to be below H1 then at step 0004 valve IV is set to establish flow path B and pump 222 is energized in the first flow direction. This of course inducts coolant from the lower tank 218 and introduces same into the coolant jacket 206.

At step 0006 timer 6 is set counting over the 6 second period and holds the system in the above just mentioned state and thus causes coolant to be continuously pumped into the coolant jacket 206 until the count finishes. This of course eliminates the need for the level sensor 224 to be provided with hysteresis characteristics and obviates any rapid ON/OFF cycling of pump 222.

At step 0007 timer 6 is cleared and at step 0008 the level of coolant in the lower tank is checked to determine if the 6 second pumping operation has depleted the supply of coolant therein to the point of reducing the level of coolant to a level lower than H2.

If the outcome of this enquiry indicates that the level has dropped below the minimum allowable level H2, then at step 0009 the operation of pump 222 is stopped and thereafter valve IV set to produced flow path A. Following this conditioning, pump 222 is energized in the second flow direction and thus pumps coolant from the reservoir 228 into the lower tank 218 to replenish the supply therein. At step 0012 the coolant level status of the lower tank 218 is checked. In the event that the level of coolant is still below level H2 the program loops until such time as the appropriate amount of coolant is introduced. At step 0013 the operation of pump 222 is stopped and at step 0014 valve IV conditioned to produce flow path B whereafter the program returns to step 0001.

As will be appreciated until the level of coolant in the coolant jacket 206 is found to be at the appropriate level in step 0002, steps 0004 to 0013 are repeated.

RADIATOR LEVEL INCREASE CONTROL (Third and Fourth Embodiments)

Figure 26:
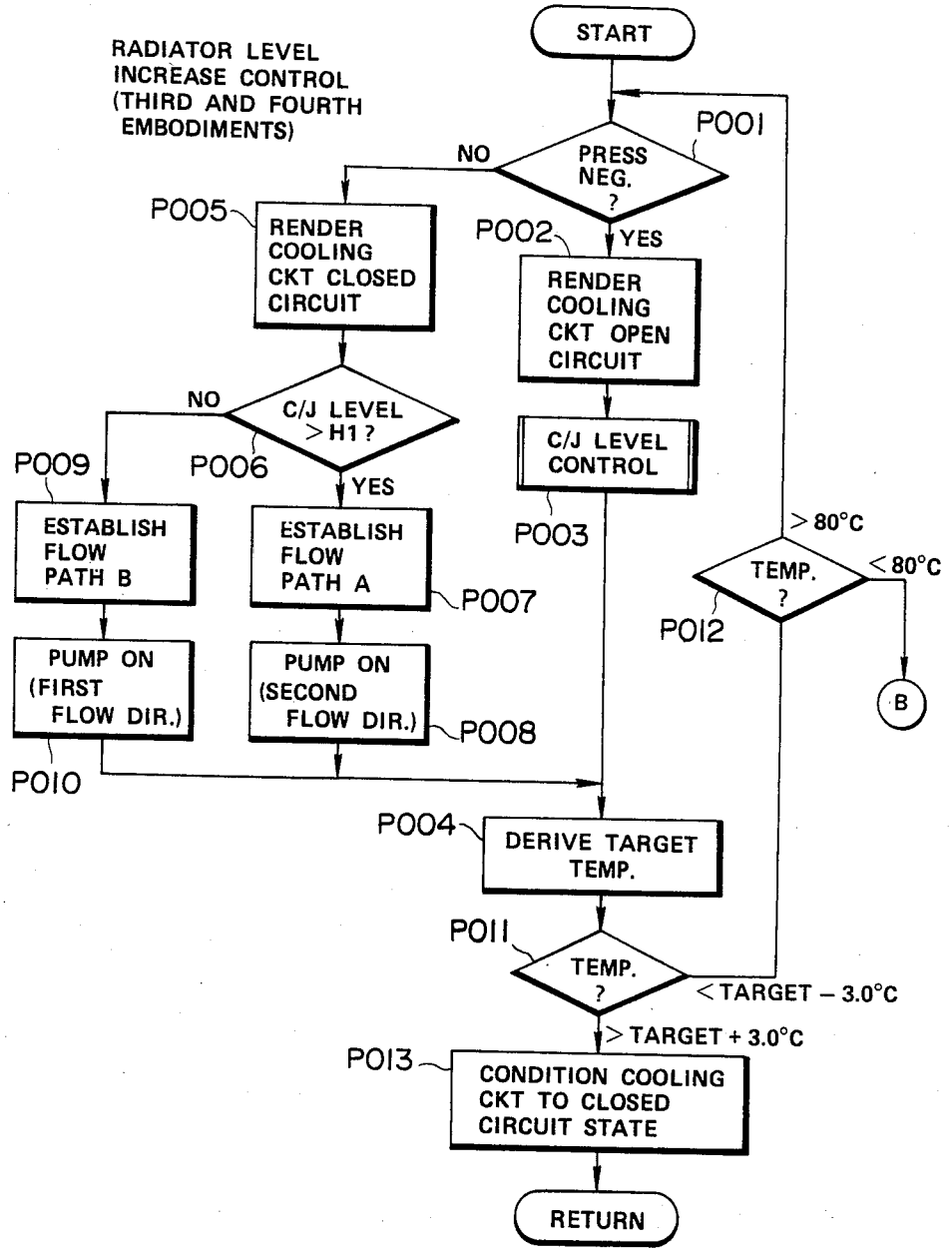

FIG. 26 shows the steps which are executed each time the program goes to step M006 (FIG. 23) of the system control routine.

As will be appreciated, this routine is run in response to the temperature of the coolant being below target by an amount which cannot be controlled simply by stopping the operation of the fan 216. The first step of this routine checks the output of the pressure differential sensor 216 and in the event that the pressure is negative, goes to step P002 wherein valve III is opened to render the cooling circuit open circuit and thereafter enters the coolant level control in step P003. While in the open circuit state coolant is inducted into the radiator 210 under the influence of the pressure differential which exists between the interior of the cooling circuit and the ambient atmosphere.

At step P004 the instant set of operating parameters (load and engine speed) are sampled and the temperature most suited for the instant set of conditions derived.

However, in the event that the pressure is found to be positive in step P001, then at step P005 the valve and conduit arrangement is conditioned to place the cooling circuit in a closed state. This of course is done by ensuring that valves I and III are closed. At step P006 the output of level sensor 224 is sampled and in the event that the level of coolant in the coolant jacket 206 is still at or above level H1 then at steps P007 and P008 valve IV is conditioned to produce flow path A and pump 222 energized in a manner to pump in the second flow direction. This both raises the level of coolant in the lower tank 218 and radiator 210 and increases the pressure within the system.

However, in the event that the level of coolant in the coolant jacket is found to be lower than H1 then at step P009 flow path B is established via the appropriate conditioning of valve IV and at step P010 pump 222 energized in the first flow direction. This, as will be readily appreciated, moves coolant from the lower tank 218 to the coolant jacket 206.

At step P011 the target value determined in the preceeding step is ranged against the instant coolant temperature. In the event that the temperature is still below the desired level by 3.0° C. then, in order to safeguard the system against control program tying up due to very cold external temperatures, at step P012 it is determined if the temperature of the coolant is above or below 80° C. If above this temperature, it is deemed that the external ambient temperatures are not effecting the control to the point of inducing a control malfunction and the program goes back to step P001. However, in the event that the coolant temperature is below the critical level (80° C.), then the program flows out of the level increase control routine and returns to step M002 (FIG. 23). This of course safeguards the system against accidental overfilling and pressurization with the system in a closed circuit state.

On the other hand, if the temperature is found to have increased toward target by a predetermined amount (in this case 1.0° C.) then at step P013 commands are issued to ensure that the system enters or remains in a closed circuit state.

ABNORMALLY HIGH TEMPERATURE CONTROL ROUTINE (Third Embodiment)

With the third embodiment, due to the entry of air into the sytem which is permitted in order to rapidly reduce the amount of coolant which must be heated during engine warm-up the possibility that air will enter the radiator 210 in quantities sufficient to reduce the efficiency thereof to the point of inducing an overheat phenonmenon is quite high. Under these circumstances it is necessary to perform what are referred to in the instant specification as "hot purges". These operations take the form of brief periods of open circuit operation which permit gasesous coolant to flow at high velocity down through the radiator 210 and vent to the reservoir 228 in a manner to scavenge out the contaminating air.

As shown, upon this routine being entered valve I is closed while valves II and III are opened. This means that coolant vapor can vent out to the reservoir via valves II and III and conduit 230. Step Q002 maintains the level of coolant in the coolant jacket 206 at the desired level until such time as the temperature of the system drops below a maximum permissible level of 115° C. It will be noted that the pressure in the circuit will drop rapidly toward atmospheric upon the system going to an open state and that this will more than likely allow the temperature to fall below the preset maximum value. Accordingly, several runs of this program may be necessary before the contaminating air is effectively removed from the system. It will also be appreciated that under cold conditions it may not in fact be necessary to remove all of the air before the temperature of the coolant can be controlled to the desired level. However, this will more than likely not be the case in hot climates and/or in the event of prolonged high speed engine operation wherein large amounts of heat must be removed from the engine.

As the remaining flow charts involved with the control of the third embodiment have been discussed hereinbefore no further discussion of same will be given for brevity.

FOURTH EMBODIMENT

Figure 10:
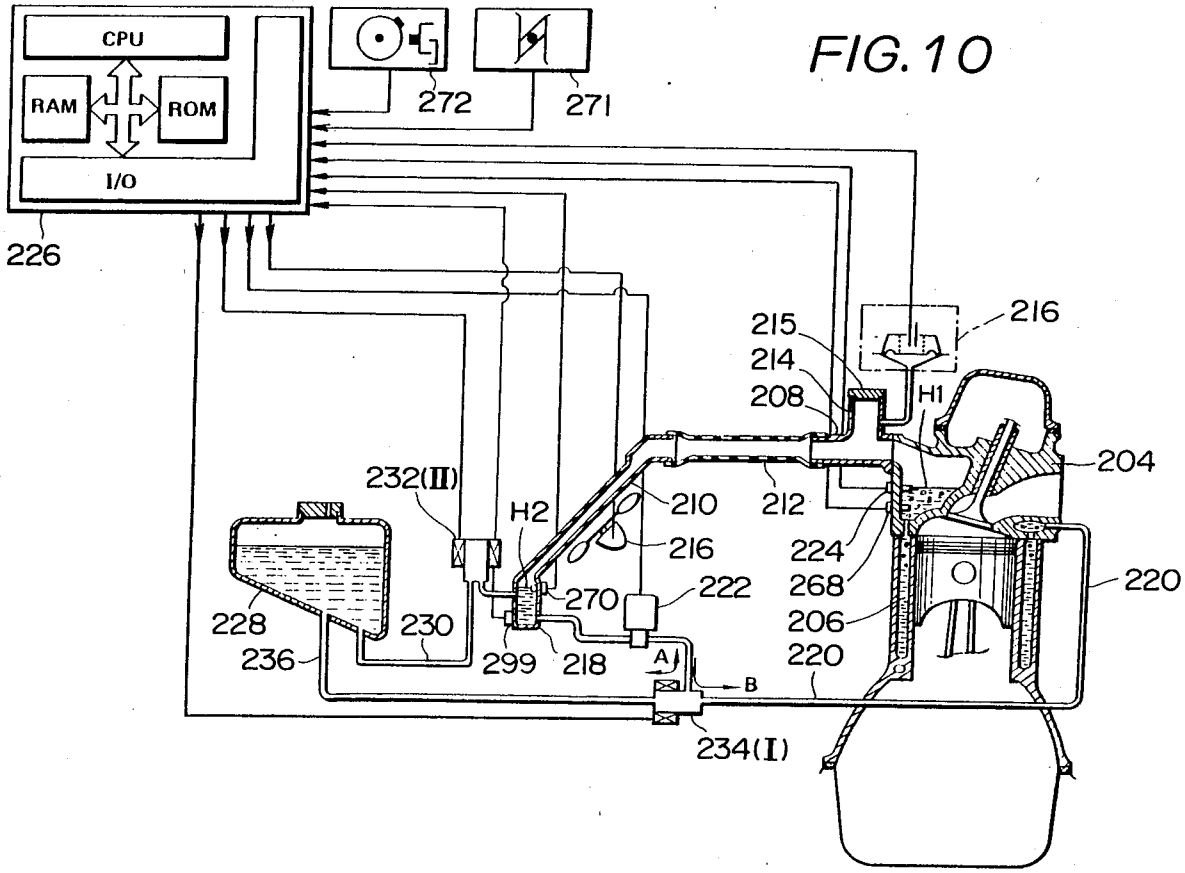
FIG. 10 shows an engine system which embodies a fourth embodiment of the present invention.

FIG. 10 shows an engine system to which the fourth embodiment of the present invention is applied. This arrangement features a simplified valve and conduit arrangement having only two electromagnetic valves, and a warm-up control wherein rapid warm-up achieved by allowing the system to initially warm-up in a open circuit condition without the introduction of coolant from the reservoir and until the temperature of the coolant reaches a relatively high level (80° C.) whereafter the system is placed in a closed circuit state and the coolant permitted to heat rapidly toward the instant target temperature. In order to accurately detect the progress of the engine warm-up a second temperature sensor 299 is disposed in the lower tank 218. By sampling the temperature at this point it is possible to detect the sudden rises in temperature which accompanies the radiator 210 becomming filled with coolant vapor and thus enables the detection of the point in the warm-up process at which the system should be switched to a closed state. Viz., as the engine coolant heats and produces coolant vapor, the excess coolant which is introduced when the engine is stopped is displaced out through valve 232 and conduit 230. During this process it is possible that some of the air (if any) which is in the system at the time of engine start-up, will be driven to the base of the radiator and even though the level of coolant has effectively reached level H2 it is preferable to leave the system in an open state so that the air can be displaced out to the radiator 210 as early as possible. Hence, by using the second temperature sensor it is possible to detect the time when the "insulating" air has been displaced and the radiator filled to the bottom with hot coolant vapor and thus the time at which it is advisable to render the system closed circuit. It will be noted that closing the system at this point enables the system to remain "open" until the "last minute" and still not suffer from the loss of heat due to venting hot coolant vapor out to the reservoir.

SYSTEM CONTROL ROUTINE (Fourth Embodiment)

Figure 28:
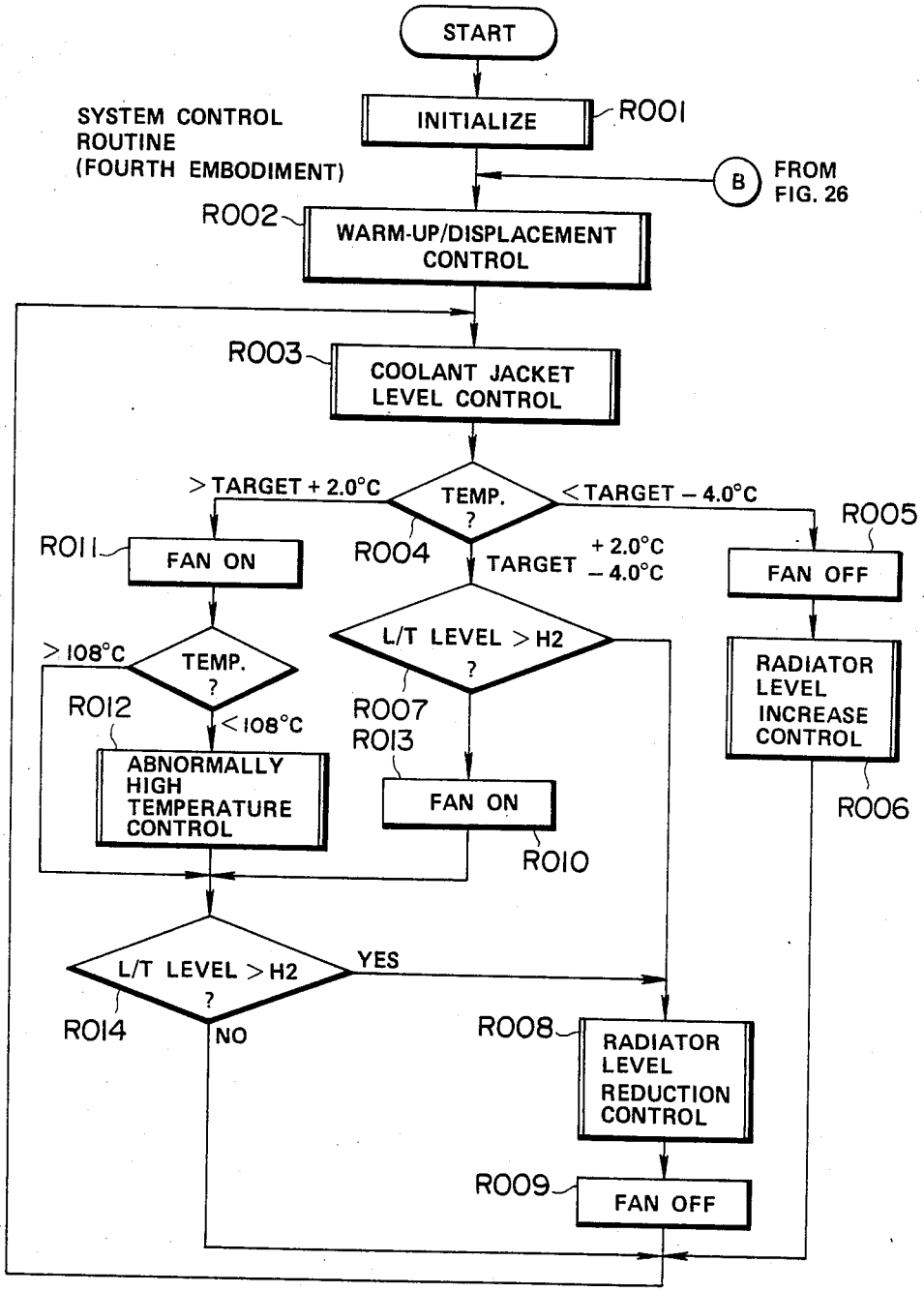

This routine (FIG. 28) is essentially the same as that disclosed in connection with FIG. 23 and differs only in that step M014 of the previously described routine is omitted (it being noted that the fourth embodiment requires only two valves). Further, it will be noted that as the routines of steps R003, R005 and R008 have been disclosed in connection with the third embodiment a redundant description of same will be omitted for brevity.

WARM-UP/DISPLACEMENT CONTROL ROUTINE (Fourth Embodiment)

Figure 29:
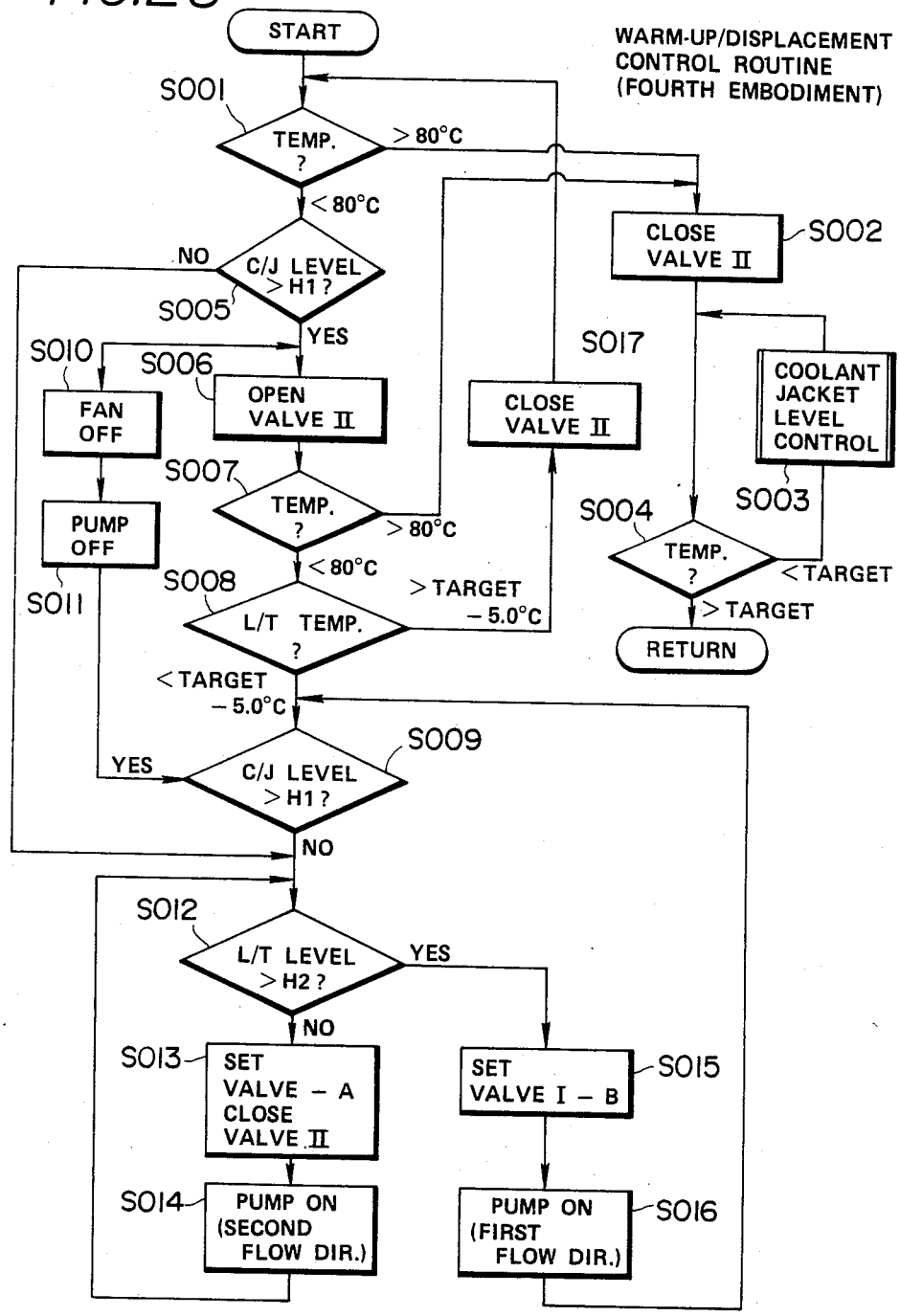

As shown in FIG. 29 the first step of this routine is such as to sample the instant coolant temperature. In the event that the coolant temperature is found to be above 80° C. then the program is directed to flow to steps S002 to S004 wherein valve II (viz., valve 232) is closed and the instant coolant temperature ranged against the instant target value. If the temperature is found to be above target in step S004 then the program is allowed to return and thus proceed to steps R003 and R004 of the system control routine. However, if the temperature is found to be on the low side of target then the program recycles while maintaining the the level of coolant in the coolant jacket via frequent runs of the coolant jacket level control routine (step S003) until such time as the temperature comes up to the desired level.

On the other hand, in the event that the enquiry conducted at step S001 indicates that the instant coolant temperature is below 80° C. then at step S005 the output of level sensor 224 is sampled and the status of the coolant level in the coolant jacket determined. In the event that level of coolant is below the critical Hl level then the program flows around to step S012 and thereafter enters a level adjustment stage (steps S012 to S016).

However, if the coolant level in the coolant jacket is above Hl and further displacement of coolant is possible, then at step S006 a command to open valve II is issued and at step S007 the instant coolant temperature ranged against a value of 80° C. If the temperature is above 80° C. then the program flows across to steps S002 to S004. However, if on the low side then at step S008 the output of temperature sensor 299 is sampled. In the event that the temperature has risen to a level of target plus 5.0° C. then it is deemed that the radiator has become filled with vapor coolant and that in order to retain as much heat as possible it is necessary to go to closed circuit operation. On the other hand, if the temperature is still on the low side (target −5.0° C.) then at step S009 the coolant jacket level is checked and if above level Hl then at steps S011 and S010 commands to stop the operation of the fan 216 and pump 222 are issued and thus promote further engine warm-up.

ABNORMALLY HIGH TEMPERATURE CONTROL ROUTINE (Fourth Embodiment)

Figure 30:
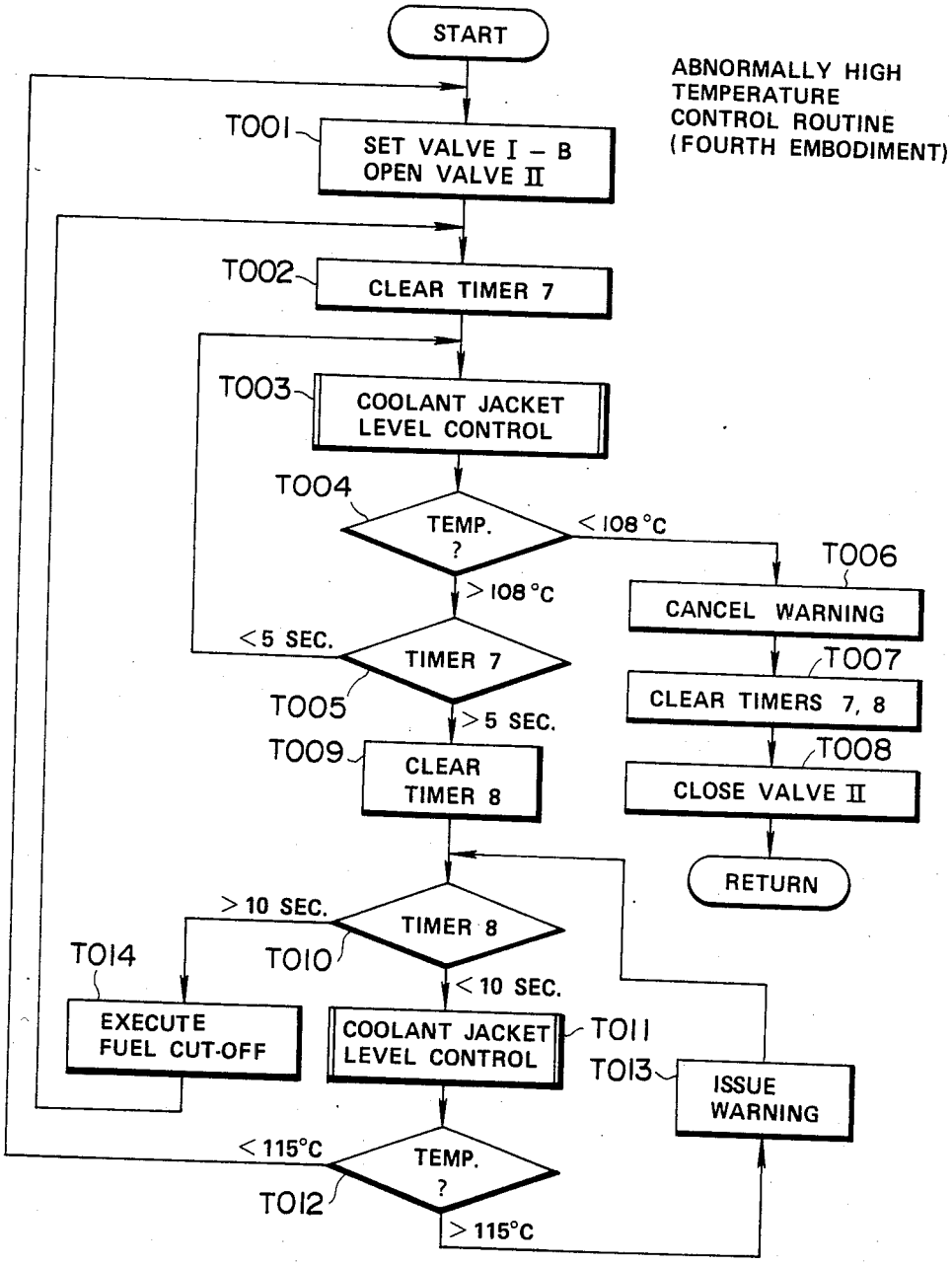

This control routine as shown in FIG. 30 is such tnat at step T001 the cooling circuit is rendered open circuit by opening valve 232 and mantaining valve 234 set to provide communication between the lower tank 218 and the coolant jacket 206 (flow path B). At step T002 a soft clock "timer 7" is cleared and at step T003 the coolant jacket level control routine is run. Following this at step T004, the output of temperature sensor 268 is sampled and in the event that the coolant temperature is found to be greater than 108° C. timer 7 is set counting in step T005.

If the temperature of the coolant drops below 108° C. within five seconds then the program goes to step T006 wherein a command to terminate the issuance of a high temperature warning is issued and thereafter flows to steps T007 and T009 wherein timers 7 and 8 are cleared and valve II is closed to return the system to a closed circuit state again.

However, if the high temperature persists for more than 5 seconds then at step T009 timer 8 is cleared and subsequently started in the next step (T010). As will be noted timer 8 is arranged to count over a period corresponding to 10 seconds. While the count remains within this period the program goes to step T011 wherein the level of coolant in the coolant jacket 206 is monitored and adjusted to level Hl; and thereafter goes to step T012 wherein the temperature is ranged against a maximum permissible value of (in this case) 115° C. If the temperature is above this level the program recycles to step step T010 and issues a warning indicating the very high temperature (step T011). If this high temperature condition cannot be brought under control either by the driver reducing speed in response to the warning issued in step T013 or automatically by the system within a period of 10 seconds then at step T014 a command to execute a partial fuel cut-off is issued in order to reduce the maximum vehicle speed to 50 km/hr (for example) in an effort to obviate any extensive thermal damage or the like to the engine. It will be noted that the fuel cut-off command is preferably not cancellable as the possibility of a major system malfunction is quite high.

Figure 27:
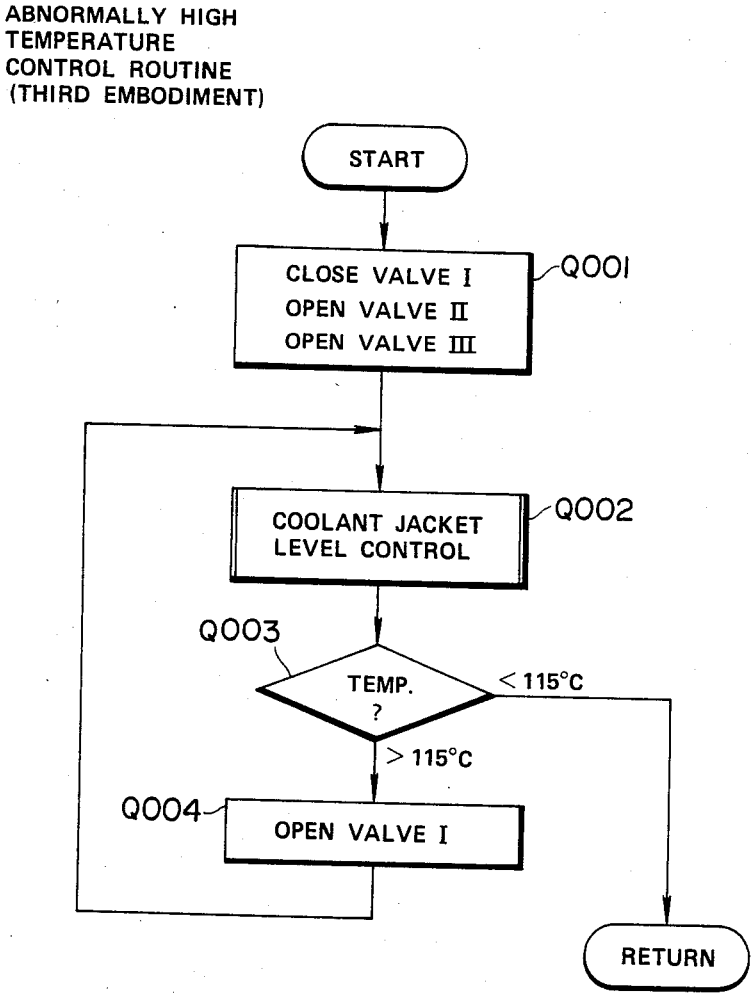

As will be appreciated the control technique disclosed in the instant control could be applied to the system control routines disclosed in FIGS. 11 and 21 for example if so desired and/or used in place of the routine shown in FIG. 27 (or example). Further, possible combinations and variations of the various control techniques used in the four embodiments will be readily apparent to those skilled in the art of engine control.

What is claimed is:

1. A method of cooling an internal combustion engine having a structure subject to high heat flux comprising the steps of:

(a) introducing liquid coolant into a coolant jacket disposed about said structure;

(b) permitting said liquid coolant to boil and produce coolant vapor;

(c) condensing the coolant vapor produced in said coolant jacket to its liquid form in a radiator which is surrounded by a cooling medium;

(d) returning the liquid coolant condensate produced in said radiator to said coolant jacket in a manner which maintains said structure immersed in a predetermined depth of liquid coolant;

(e) sensing the temperature of the coolant in said coolant jacket; and (f) promoting rapid engine warm-up by displacing non-condensable matter from a cooling circuit which includes said coolant jacket and said radiator, only when the temperature sensed in step (e) is above a predetermined value.

2. A method as claimed in claim 1, wherein said predetermined value is selected to be one of (a) a low value whereat the engine is cold and the introduction of cold coolant into said coolant jacket from an auxiliary reservoir would hamper warm-up and (b) a predetermined amount above a variable value which is derived in response to current engine operating conditions.

3. A method of cooling an internal combustion engine having a structure subject to high heat flux comprising the steps of:

(a) introducing liquid coolant into a coolant jacket disposed about said structure;

(b) permitting said liquid coolant to boil and produce coolant vapor;

(c) condensing the coolant vapor produced in said coolant jacket to its liquid form in a radiator which is surrounded by a cooling medium;

(d) returning the liquid coolant produced in said radiator to said coolant jacket in a manner which maintains said structure immersed in predetermined depth of coolant;

(e) sensing the temperature of the coolant in said coolant jacket;

(f) storing coolant in a reservoir;

(g) permitting the coolant in said reservoir to enter and fill said coolant jacket and radiator when the engine is stopped and below a first predetermined temperature;

(h) pumping coolant into said coolant jacket and radiator when the engine is started in a manner that the excess coolant introduced into said coolant jacket and radiator overflows via an overflow conduit back to said reservoir in a manner which flushes non-condensible matter out of said coolant jacket and radiator;

(i) sensing the temperature of the coolant in one of said radiator and coolant jacket; and (j) delaying the step of pumping coolant when the temperature of the coolant is sensed being below a second predetermined temperature which is lower than said first predetermined temperature until the temperature of the coolant has risen above a third predetermined value.

4. A method as claimed in claim 3, wherein said third predetermined temperature is intermediate of said first and second predetermined temperatures and which further comprises the step of by-passing said step of pumping if the temperature of the coolant is at or above said third predetermined temperature when the engine is started.

5. In a method of cooling an internal combustion engine having a structure subject to high heat flux, the steps of:

(a) introducing liquid coolant into a coolant jacket disposed about said structure;
(b) permitting said liquid coolant to boil and produce coolant vapor;
(c) condensing the vapor produced in said coolant jacket to its liquid form in a radiator which is surrounded by a cooling medium;
(d) returning the liquid coolant condensate from said radiator to said coolant jacket in a manner to maintain said structure immersed in a predetermined depth of liquid coolant;
(e) storing coolant in a reservoir;
(f) pumping coolant from said reservoir into said radiator in a manner which varies the amount of coolant in the radiator and varies the surface area of the radiator via which coolant vapor can release its latent heat of evaporation;
(g) sensing the ambient temperature;
(h) modifying the pumping in step (f) in response to the ambient temperature being sensed below a predetermined low temperature in step (g).

6. A method as claimed in claim 5 wherein said step of modifying comprises the steps of:

timing the period over which pumping is executed and in the event that the pumping continues for a period in excess of a predetermined length,
sampling the ambient temperature and if below said predetermined low temperature stopping the pumping operation.

7. In a method of cooling an internal combustion engine having a structure subject to high heat flux, the steps of:

(a) introducing liquid coolant into a coolant jacket disposed about said structure;
(b) permitting said liquid coolant to boil and produce coolant vapor;
(c) condensing the vapor produced in said coolant jacket to its liquid form in a radiator which is surrounded by a cooling medium;
(d) returning the liquid coolant condensate from said radiator to said coolant jacket in a manner to maintain said structure immersed in a predetermined depth of liquid coolant;
(e) sensing the temperature of the coolant in said coolant jacket;
(f) storing coolant in a reservoir;
(g) permitting coolant in said reservoir to enter and fill said coolant jacket and radiator when the engine is stopped and below a selected temperature;
(h) pumping coolant out of said coolant jacket and radiator to the reservoir;
(i) permitting non-condensible matter to enter said coolant jacket and radiator in a manner which prevents the formation of a negative pressure;
(j) sealing the coolant jacket and radiator in a manner to defined a closed circuit cooling circuit upon one of:
(i) a minimum amount of coolant is retained in said cooling circuit, and
(ii) the coolant boils at a temperature determined to be that most suited form the instant set of operational conditions; and
(k) venting coolant vapor from the radiator in a manner to scavenge the non-condensible matter out of the cooling circuit in the event that the temperature of the coolant exceeds a predetermined upper limit.

8. A method as claimed in claim 7, further comprising the steps of:

sensing operational parameters of the engine;
determining on the basis of the data derived in said step of operational parameter sensing, the temperture which is most suited to the instant set of operating conditions.

9. In a method of cooling an internal combustion engine having a structure subject to high heat flux, the steps of:

(a) introducing liquid coolant into a coolant jacket disposed about said structure;
(b) permitting said liquid coolant to boil and produce coolant vapor;
(c) condensing the vapor produced in said coolant jacket to its liquid form in a radiator which is surrounded by a cooling medium;
(d) returning the liquid coolant condensate from said radiator to said coolant jacket in a manner to maintain said structure immersed in a predetermined depth of liquid coolant;
(e) sensing the temperature of the coolant in said coolant jacket;
(f) storing coolant in a reservoir;
(g) permitting the coolant in said resevoir to enter and fill said radiator when the engine is stopped and below a first predetermined temperature;
(h) permitting the coolant in said coolant jacket to heat when the engine is started with the coolant jacket and radiator conditioned so that the cooling circiut defined by said coolant jacket and said radiator assumes an open circuit state wherein fluid communication between said coolant jacket and said radiator and said reservoir is permitted;

sensing the temperature at a lower portion of said radiator; and
using a change in temperature at the lower portion of said radiator as a signal to seal said radiator and coolant jacket so as to assume a closed circuit state by cutting off fluid communication betweeen said radiator and coolant jacket and the reservoir.

10. In an internal combustion engine having a structure subject to high heat flux, a cooling system comprising:

(a) a cooling circuit which comprises:

a cooling jacket disposed about said structure and into which coolant is introduced in liquid form and permitted to boil;
a radiator in fluid communication with said coolant jacket in which gaseous coolant is condensed to its liquid form;
means for returning liquid coolant from said radiator to said coolant jacket in a manner which maintains said structure immersed in a predetermined depth of liquid coolant;

(b) a first temperature sensor for sensing the temperature of the coolant in said coolant jacket;

(c) a device associated with said radiator for increasing the heat exchange between the raidator and a cooling medium surrounding said radiator;

(d) a reservoir in which liquid coolant is stored;

(e) valve and conduit means interconnecting said reservoir and said cooling circuit; and (f) a control circuit which is responsive to said sensor for controlling said device and said valve and conduit means, said control circuit comprising:

means for promoting rapid engine warm-up by displacing non-condensable matter from said cooling circuit, only when said first temperature sensor indicates that the temperature of the coolant in said coolant jacket is above a predetermined value.

11. A cooling system as claimed in claim 10, wherein said predetermined value is selected to be one of (a) a low value whereat the engine is cold and the introduction of additional cold coolant from said reservoir into said coolant jacket would hamper warm-up and (b) a predetermined amount above a variable value which is derived in response to current engine operating conditions.

12. In an internal combustion engine having a structure subject to high heat flux, a cooling system comprising:

(a) a cooling circuit which comprises:

a cooling jacket disposed about said structure and into which coolant is introduced in liquid form and permitted to boil;

a radiator in which gaseous coolant is condensed to its liquid form;

a vapor transfer conduit leading from said coolant jacket to said radiator for transferring coolant vapor generated by the boiling of the liquid coolant in said coolant jacket to said radiator for condensation therein;

means for returning liquid coolant from said radiator to said coolant jacket in a manner which maintains said structure immersed in a predetermined depth of liquid coolant;

(b) a first temperature sensor for sensing the temperature of the coolant in said coolant jacket;

(c) a device associated with said radiator for increasing the heat exchange between the radiator and a cooling medium surrounding said radiator;

(d) a reservoir in which liquid coolant is stored;

(e) valve and conduit means interconnecting said reservoir and said cooling circuit; and (f) a control circuit which is responsive to said sensor for controlling said device and said valve and conduit means, said control circuit comprising:

means responsive to a parameter which varies with the ambient temperature for modifying the operation of said valve and conduit means to vary the amount of liquid coolant which is transferred between the cooling circuit and the reservoir in a manner which promotes rapid system warm-up;

wherein said liquid coolant returning means comprises:

a return conduit leading from said radiator to said coolant jacket;

a reversible coolant pump disposed in said return conduit, said pump being energizable to pump coolant in a first flow direction from said radiator toward said coolant jacket and in a second flow direction from said coolant jacket toward said radiator; and a first level sensor disposed in said coolant jacket at a predetermined height above said structure.

13. A cooling system as claimed in claim 12, further comprising a pressure differential responsive switch arrangement which is responsive to the pressure differential which exists between the interior of said cooling circuit and the ambient atmospheric pressure.

14. A cooling circuit as claimed in claim 12, wherein said valve and conduit means comprises:

a first three-way valve disposed in said return conduit at a location between said pump and said coolant jacket;

a first conduit leading from said reservoir to said first valve, said first valve having a first state wherein communication between said pump and said coolant jacket is established and communication between said pump and said reservoir is cut-off and a second state wherein communication between said pump and said coolant jacket is interrupted and communication between said reservoir and said pump is established;

a second conduit leading from said reservoir to said cooling circuit at a location between said radiator and said pump; and a second valve disposed in said second conduit, said second valve having a first state wherein communication between said reservoir and said radiator is cut-off and a second state wherein the communication is established.

15. A cooling system as claimed in claim 14, wherein said valve and conduit means further comprises:

a third conduit leading from a position near the top of said cooling circuit to said reservoir; and a third valve disposed in said third conduit, said third valve having a first normally closed state wherein communication between said cooling circuit and said reservoir is cut-off and a second state wherein the communication is established.

16. A cooling system as claimed in claim 15, wherein said second conduit communicates with said return conduit and wherein said valve and conduit means further comprises a fourth valve, said fourth valve being disposed in said return conduit at a location between said radiator and the location at which said second conduit communicates therewith.

17. A cooling system as claimed in claim 12, further comprising an ambient temperature sensor, for sensing the temperature of environment in which the engine is located.

18. A cooling system as claimed in claim 12, wherein said valve and conduit means further comprises a second level sensor disposed at the bottom of said radiator for sensing whether the level of coolant is at a second predetermined level which is selected to be lower than the heat exchanging surface area of the radiator.

19. In an internal combustion engine having a structure subject to high heat flux, a cooling system comprising:

(a) a cooling circuit which comprises:

a cooling jacket disposed about said structure and into which coolant is introduced in liquid form and permitted to boil;

a radiator in which gaseous coolant is condensed to its liquid form;

a vapor transfer conduit leading from said coolant jacket to said radiator for transferring coolant vapor generated by the boiling of the liquid coolant in said coolant jacket to said radiator for condensation therein;

means for returning liquid coolant from said radiator to said coolant jacket in a manner which maintains said structure immersed in a predetermined depth of liquid coolant;

(b) a first temperature sensor for sensing the temperature of the coolant in said coolant jacket;

(c) a device associated with said radiator for increasing the heat exchange between the radiator and a cooling medium surrounding said radiator;

(d) a reservoir in which liquid coolant is stored;

(e) valve and conduit means interconnecting said reservoir and said cooling circuit;

(f) a control circuit which is responsive to said sensor for controlling said device and said valve and conduit means, said control circuit comprising:

means responsive to a parameter which varies with the ambient temperature for modifying the operation of said valve and conduit means to vary the amount of liquid coolant which is transferred between the cooling circuit and the reservoir in a manner which promotes rapid system warm-up; and (g) a second temperature sensor disposed at the bottom of said radiator.

* * * * *